US007178194B2

(12) United States Patent
Damrath et al.

(10) Patent No.: US 7,178,194 B2
(45) Date of Patent: Feb. 20, 2007

(54) MOP

(75) Inventors: Joachim Damrath, Bachhagel (DE); Markus Spielmannleitner, Ellwangen (DE); Gerhard Wetzl, Sontheim (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 11/191,278

(22) Filed: Jul. 25, 2005

(65) Prior Publication Data

US 2006/0016038 A1 Jan. 26, 2006

Related U.S. Application Data

(63) Continuation of application No. PCT/EP03/13587, filed on Dec. 2, 2003.

(30) Foreign Application Priority Data

Dec. 2, 2002 (DE) ..... 102 56 089
Dec. 2, 2002 (DE) ..... 102 56 090
Dec. 2, 2002 (DE) ..... 102 56 091

(51) Int. Cl.
*A47K 7/02* (2006.01)

(52) U.S. Cl. ..... 15/228; 15/262

(58) Field of Classification Search ..... None
See application file for complete search history.

(56) References Cited

U.S. PATENT DOCUMENTS

| | | | | |
|---|---|---|---|---|
| 6,588,045 | B2 * | 7/2003 | Fernandez | 15/119.2 |
| 2002/0011813 | A1 | 1/2002 | Koselka et al. | |
| 2002/0026680 | A1 | 3/2002 | Kingry et al. | |
| 2003/0009839 | A1 * | 1/2003 | Streutker et al. | 15/228 |
| 2005/0011536 | A1 * | 1/2005 | Hofte et al. | 134/6 |

FOREIGN PATENT DOCUMENTS

| | | | |
|---|---|---|---|
| BE | 355 509 | | 12/1928 |
| EP | 0 797 948 | A1 | 10/1997 |
| EP | 1 219 226 | A1 | 7/2002 |
| EP | 1219226 | * | 7/2002 |

* cited by examiner

*Primary Examiner*—David Redding
(74) *Attorney, Agent, or Firm*—Laurence A. Greenberg; Werner H. Stemer; Ralph E. Locher

(57) ABSTRACT

A mop has a holder for attaching a mop covering. The holder is composed of an at least substantially rigid core and of a flexible edge lining that is placed along a part or all of the edge of the flat core, and/or the mop covering projects beyond the holder on at least one portion of the periphery of the holder. The core is preferably encapsulated with the material of the edge lining by injection molding in order to achieve an improved joining and the provision of a small gap between the core and the edge lining.

12 Claims, 16 Drawing Sheets

MOP

CROSS-REFERENCE TO RELATED APPLICATION

This is a continuing application, under 35 U.S.C. § 120, of copending international application No. PCT/EP03/13587, filed Dec. 2, 2003, which designated the United States; this application also claims the priority, under 35 U.S.C. § 119, of German patent applications Nos. 102 56 090.0, 102 56 091.9, 102 56 089.7, all filed on Dec. 2, 2002; the prior applications are herewith incorporated by reference in their entirety.

BACKGROUND OF THE INVENTION

Field of the Invention

The present invention relates to a mop with a holder for attaching a mop cover particularly for usage with a device for extracting liquid from the mop cover.

German published patent application DE 100 65 369 describes a device for moistening and de-moistening a mop with an absorbent mop cover wherein the device has a spray for wetting the mop cover and two rollers that drive a carrier plate in the rotation direction. The rollers are arranged in such a manner that the mop cover can be moved into the nip of the rollers, thus being wrung out in the process. The mop cover is attached on the lower side to a stiff, flat holder of the mop such that the mop cover and the holder have the same outline. The resulting disadvantage of this arrangement is that the mop hits obstructions with its stiff holder, and in doing so sometimes damages the object posing the obstruction.

SUMMARY OF THE INVENTION

It is accordingly an object of the invention to provide a mop device, which overcomes the above-mentioned disadvantages of the heretofore-known devices and methods of this general type and which provides for a mop with a mop cover that can be wrung out in a device used for this purpose and the use of which involves a much lesser risk of damaging obstructing objects.

With the foregoing and other objects in view there is provided, in accordance with the invention, a mop, comprising:

a mop cover;

a holder for fastening said mop cover, said holder having a substantially flat, stiff core and an elastic edge trim disposed along at least one part of said core, and/or wherein the mop cover projects over at least one part of a periphery of said holder.

Pursuant to the invention, the holder to which the mop cover is attached comprises a flat, stiff core and an elastic edge trim. The stiff core makes it possible to apply pressure on the entire surface of the mop cover and to wring out the mop cover evenly all over its surface. Due to the stiff core of the holder, it is not necessary to apply pressure evenly all over the surface of the holder. Instead, the pressure can be applied only on the edges of the holder. Thus it is advantageously possible to construct the wringing device for the mop cover in a variety of forms. The fact that the pressure can be applied only on the edges of the holder enables the use of a holder with a handle attached to it because it is generally very difficult to apply pressure on the holder by applying pressure on the necessary junction between the handle and the holder.

Likewise the task pursuant to the invention is solved by a flat holder to which a soft, flat mop cover is attached that projects over at least one part of the periphery of the holder. Since the mop cover is soft, it can protect other objects from damages caused by the holder, which as a rule is hard for the purpose of achieving sufficient stability for usage in a device for wringing out the mop cover. The mop cover advantageously projects over the holder at the points that are most likely to hit against an obstructing object. A mop cover projecting over the holder can also be used together with a holder that has a hard core with a soft edge trim.

The edge trim also prevents an obstructing object, such as for instance a piece of furniture, from being damaged as a result of the holder hitting against it with its hard core. The combination of the stiff core with the edge trim as an edge protector firstly provides the holder with the required stability for usage in a wringing device and secondly reduces the risk of damaging obstructing objects.

The core can comprise, for instance, of metal or a stable fiber-reinforced plastic. Furthermore, even the core is flat, enabling its usage in combination with a flat mop cover.

The soft mop cover is advantageously elastic and can particularly comprise of a plastic material, for instance, an elastomer. Moreover, the edge trim can be provided along the entire periphery of the edge of the core. Similarly, the edge trim can be provided only on selected points of the edge of the core that are exposed and most likely to hit against obstructing objects while using the mop.

The edge trim can have a friction-fit connection to the core, for instance, by clamping the edge trim around the edge of the core. In addition, even a groove and/or a depression can be provided in the edge of the core into which an appendage of the edge trim can be force-fitted or form-locking. Alternatively or additionally, the edge trim can also be attached to the core using a force-fit connection. For instance, the edge trim can be designed in such a manner that it surrounds the core by extending around the entire periphery of the edge of the core and projects somewhat over and under the core. Apart from that, the edge trim can also encompass corresponding sections of the edge of the core whose thickness increases towards the periphery.

In a particularly advantageous embodiment of the invention, the core is injection-molded with the edge trim bringing about a particularly tight connection between the core and the edge trim that has none or only a small gap preventing contaminants from collecting between the core and the edge trim. Furthermore, attaching the edge trim to the core using the injection-molding process also effectively reduces the costs involved.

The edge trim can also completely enclose the core and/or be a part of a covering for the core. The resulting advantage is that the core is no longer exposed to the surroundings and thus also to any corrosion. In this case, a cost-effective material can be used to manufacture the core that, firstly, has the required mechanical properties and, secondly, corrodes easily in certain circumstances. This applies to numerous metals. Since the mop necessarily comes into contact with liquid, and with water in particular, the complete enclosure of the core enables a cost-effective construction by using a favorable but corrosion-prone metal as the material for the core that is completely surrounded by a more resistant material like plastic for the purpose of preventing any corrosion and in addition, for fulfilling the function of protecting the edges.

If the core comprises of a plastic, then an edge trim made of plastic can also be molded on such that both the plastics partially fuse with one another at the joint. In this manner it is possible to create a part with a sliding junction between the plastic materials and thus achieve the desired material properties for the holder with a very deep connection between the core and the edge trim.

The mop pursuant to the invention is configured particularly for usage in a device for moistening and/or wringing out the mop cover wherein the device can compress the holder and thus the mop cover between pressure elements. Pressure elements acting on the side lying opposite to the mop cover do not apply pressure over the entire surface of the holder. The pressure elements create no pressure at least in one region of the surface of the holder. This occurs in frequent cases whenever the holder is connected to a handle that is not removed before wringing out the mop.

Particularly for usage with a wringing device, the holder is advantageously designed such that its thickness is constant all over its surface. For this purpose, the core and its edge trim must be adjusted to one another such that the region where the core and the edge trim overlap one another has a constant combined height. Due to this, in the wringing device, the distance of the coactive pressure elements above the width or surface can remain constant and the pressure elements can be designed with a simpler shape. For the purpose of achieving a constant thickness, the core can be designed to be thinner in the region where the edge trim stretches over or below it.

Other features which are considered as characteristic for the invention are set forth in the appended claims.

Although the invention is illustrated and described herein as embodied in a Mop, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
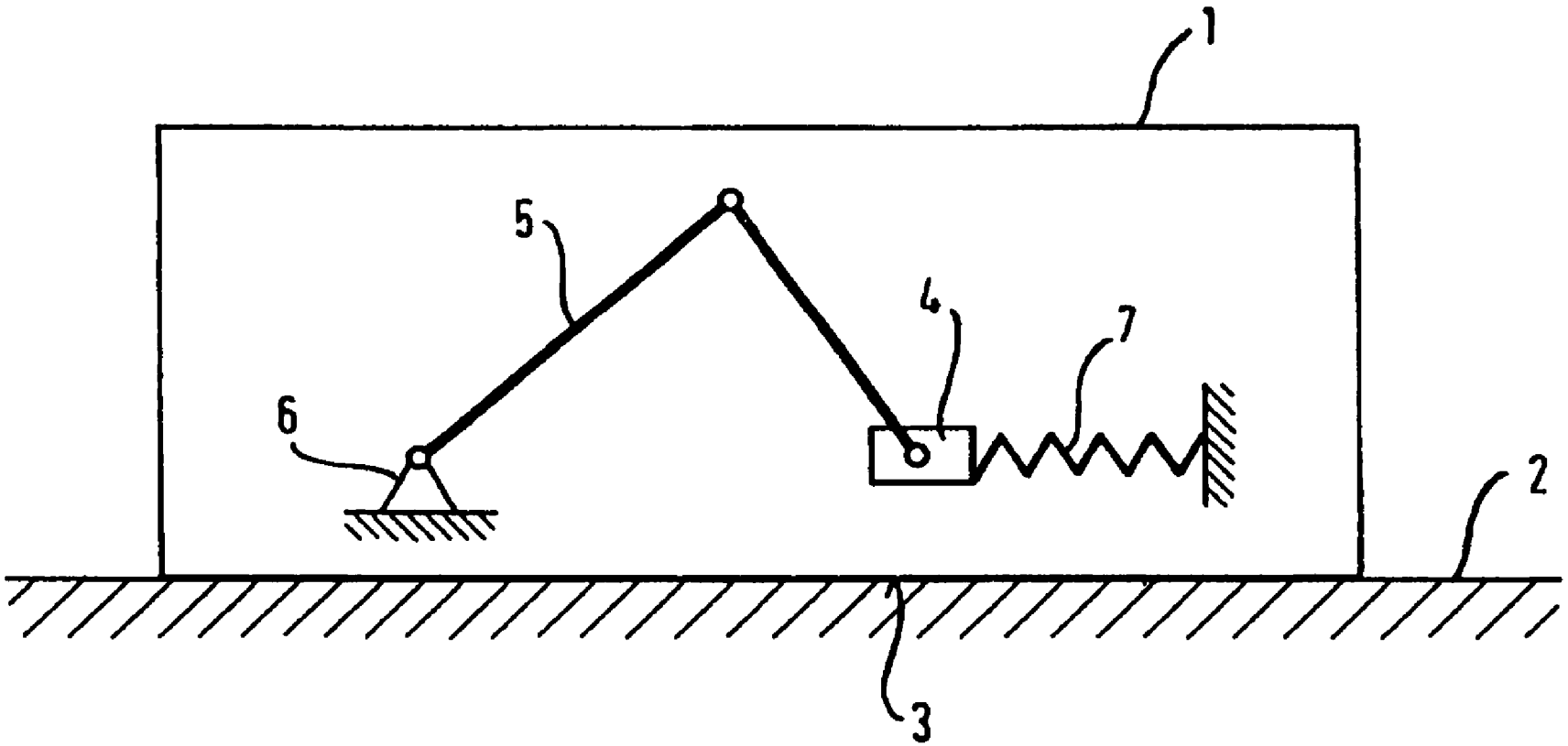
FIG. 1 is a schematic diagram of a drive with an inertial mass.

Referring now to the figures of the drawing in detail and first, particularly, to FIG. 1 thereof, there is shown a schematic illustration of an inertial mass drive pursuant to the invention. A wiping device 1 is used for wet wiping or wiping and thus cleaning floors in households or in other interior spaces. It is illustrated in FIG. 1 as a plain cuboid. The wiping device 1 lies on a floor 2 with its wiping surface 3 turned toward the floor.

In the wiping device 1 only a symbolically illustrated inertial mass 4 is provided that is mounted such that it can move horizontally. In this case, it is driven by a drive motor 6 against the force of a spring 7 using an assembly of levers 5 that is also only symbolically illustrated. Thus, the drive motor 6 stresses the spring 7 up to a point where a release mechanism disconnects the drive motor 6 and/or decouples the inertial mass 4 from the force of the drive motor. Subsequently, the spring 7 is able to accelerate the inertial mass 4 relatively quickly. In FIG. 1, the spring accelerates the inertial mass toward the left. During this phase of acceleration, the base, i.e. the remaining part of the wiping device 1 experiences a reaction force or torque that accelerates the wiping device 1 against the static friction between the wiping surface 3 and the floor 2. In FIG. 1, this is a movement toward the right.

The sliding friction between the wiping surface 3 and the floor 2 slows down this movement after a defined sliding distance. Furthermore, the spring 7 pushes the inertial mass 4 away from it. Consequently, the drive motor 6 can again move the inertial mass 4 to the right using the assembly of levers 5 in order to stress the spring 7. However, this leads to such small accelerations of the inertial mass 4 to the right that the stressing of the spring 7 leads to a complimentary jerky movement of the wiping device 1 toward the left. Using the iterative movement of the described process, the wiping device 1 slips to the right in steps by overcoming the static friction between the wiping surface 3 and the floor 2. This explains the basic principle of the inertial mass drive using a model example and particularly with respect to a linear movement of the inertial mass 4.

Alternatively, the movement of the inertial mass 4 by the drive motor 6 could be used as the inertial mass movement for the movement phase. In that case, the wiping device 1 moves toward the left in steps. The spring 7 is used here only as energy storage in order to bring back the inertial mass 4 into its initial position for a new acceleration by the drive motor 6. The spring 7 here represents an arbitrary type of energy storage, for instance, an electric type (capacitors). It must be pointed out here that the energy for the return of the movement does not necessarily have to originate from the drive motor 6.

Figure 2:
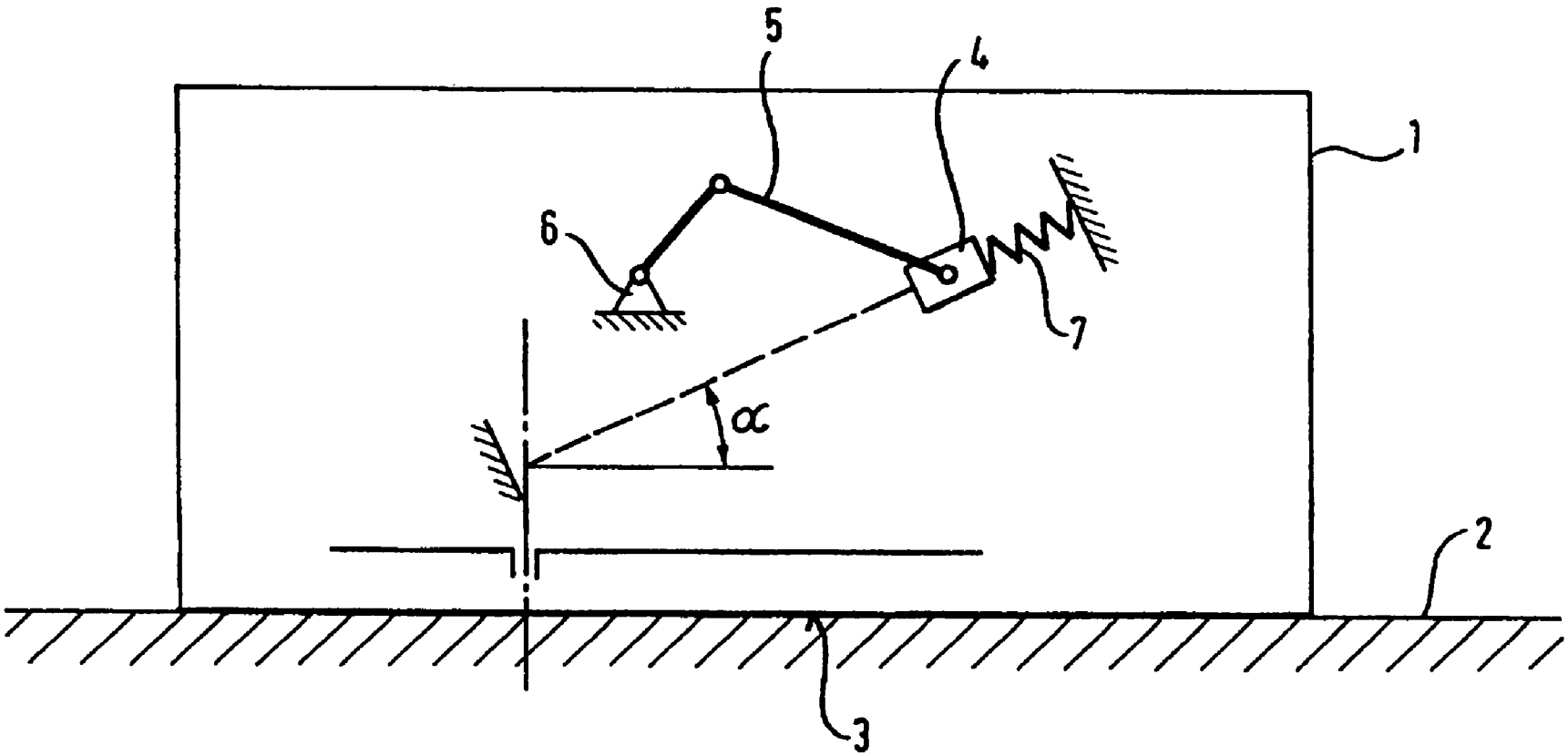
FIG. 2 is a schematic diagram of a variant of FIG. 1.

FIG. 2 illustrates a very similar model case in which the same reference symbols are used as in FIG. 1. The difference in the mechanics illustrated in FIG. 2 compared to that in FIG. 1 is in the horizontal tipping of the movement path of the inertial mass 4 by the angle α. As a result, during the acceleration of the inertial mass 4 by means of the spring 7 a reaction force or a recoil force acts on the wiping device 1 that is also horizontally tipped by the angle α. Thus, it has a component that is directed against the gravitational force. Thus both a horizontal impulse directed toward the right as well as a vertical impulse directed upward act on the center of gravity of the wiping device 1. To put it vividly, the wiping device 1 thus becomes lighter in this movement phase, i.e. the resulting force that is effective for the friction between the wiping surface 3 and the floor 2 becomes smaller. It must be clearly pointed out here that in the layout of the inertial mass drive, larger and smaller decelerations and accelerations in terms of time and also the direction of these accelerations and decelerations can influence when the static friction is overcome and when it is not.

An additional alternative to the operations illustrated on the basis of FIGS. 1 and 2 is to allow a natural oscillation of the inertial mass 4 and the spring 7 as the linear oscillator by means of the drive motor 6 in an almost resonant state. In the variant illustrated in FIG. 2 that is tilted by the angle α, the differing influence of the static friction in both the reversal points of this oscillation results in the desired static phases and the sliding movement phases. In the variant illustrated in FIG. 1, the inertial mass 4 could be braked relatively severely, for instance, at any of the two reversal points using an elastic wall that is not illustrated here or using another comparatively harder spring. This would then result in appropriately large forces of deceleration using which the static friction can be overcome.

Figure 3:
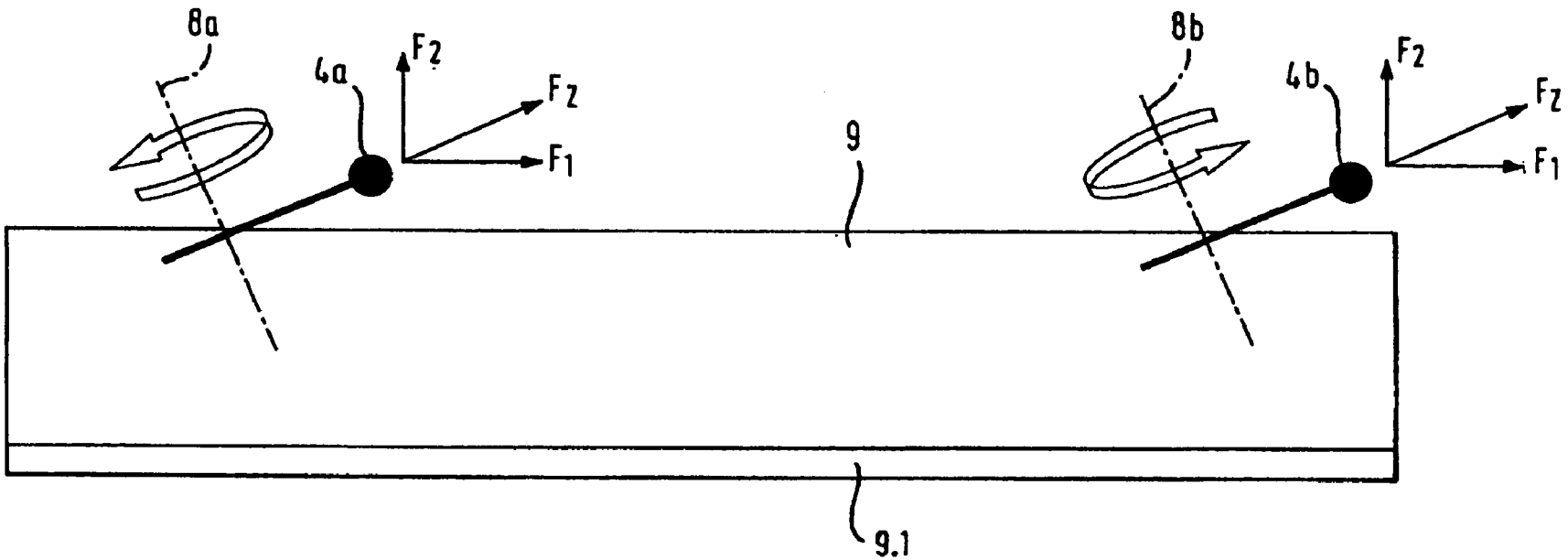
FIG. 3 is an illustration of a wiping device pursuant to the invention with an alternative inertial mass drive.

FIG. 3 illustrates another embodiment of an inertial mass drive. Here two inertial masses 4*a* and 4*b* are provided that are mounted excentrically and rotatably. Reference symbols 8*a* and 8*b* indicate the rotation axes of this rotation. Both the inertial masses 4*a* and 4*b* rotate synchronously and also counter rotate. The planes of rotation and the rotation axes 8*a* and 8*b* are inclined. The synchronous rotations of the inertial masses 4*a* and 4*b* are isochronous at the respective highest (illustrated in FIG. 3) and the respective lowest angular point. At the highest angular point the centrifugal forces sum up with a vertical component that reduces the gravitation and a horizontal component. The horizontal components and the vertical components are indicated by $F_1$ and $F_2$ respectively. The inclined centrifugal force, on the other hand, is indicated by $F_Z$. The centrifugal forces can move the wiping device that is indicated here with 9 by a definite sliding distance toward the right. The centrifugal forces also sum up in every lowest angular point of the rotation paths of the inertial masses 4*a* and 4*b*. However, here they intensify the force that is important for the static friction and that results from the gravitational force of the wiping device 9 and the vertical component of the centrifugal forces. The counter rotation of both the inertial masses 4*a* and 4*b* compensate for the inertial forces in the remaining region of the respective paths at least in part. As a result the static friction there is also not exceeded. In contrast, the sliding phase relates to a definite environment in terms of time of the state illustrated in FIG. 3. Using a suitable layout, i.e. a coordination of the friction coefficients, the weights, radii and speeds as well as tipping angles of the inertial masses 4*a* and 4*b* with one another, the wiping device 9 remains in a straight position in these deepest angular points as a result of the static friction. In this embodiment the iterative sliding phases can also be achieved by means of a continuous circular motion of the inertial masses.

Figure 4:
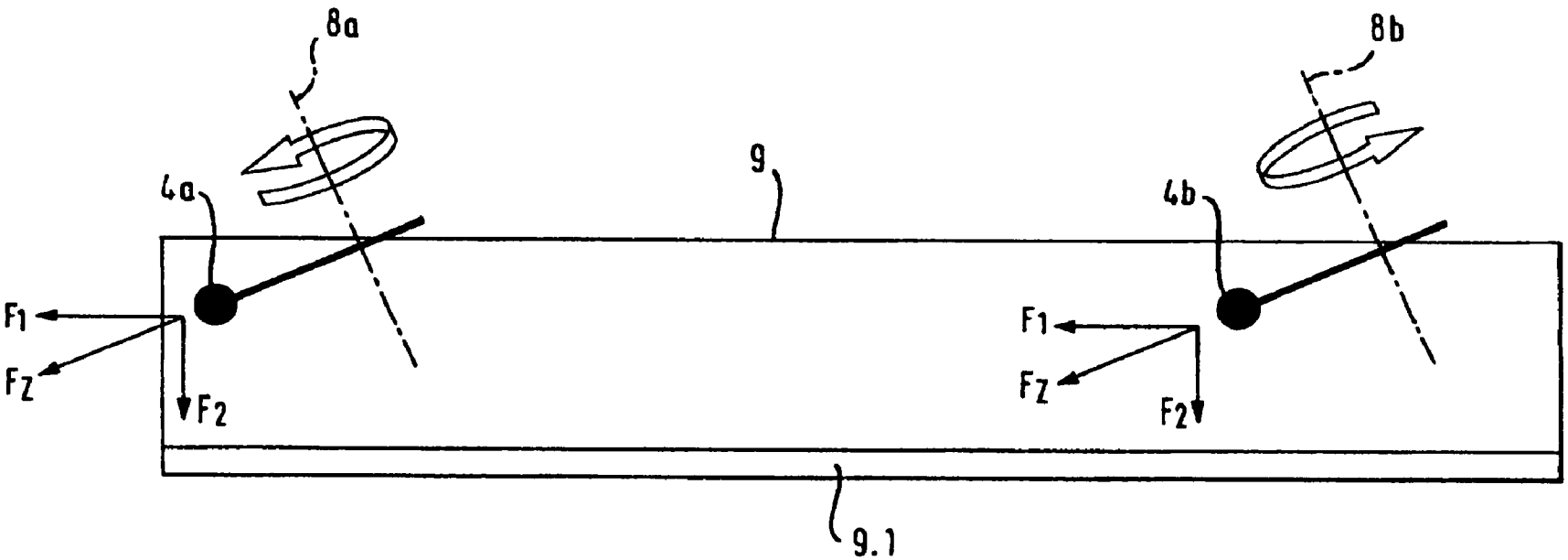
FIG. 4 illustrates the wiping device in FIG. 3 in another movement state.

FIG. 4 illustrates the standstill phase. Here the inertial masses are in the respective deepest angular point of the respective circular motion.

Figure 5:
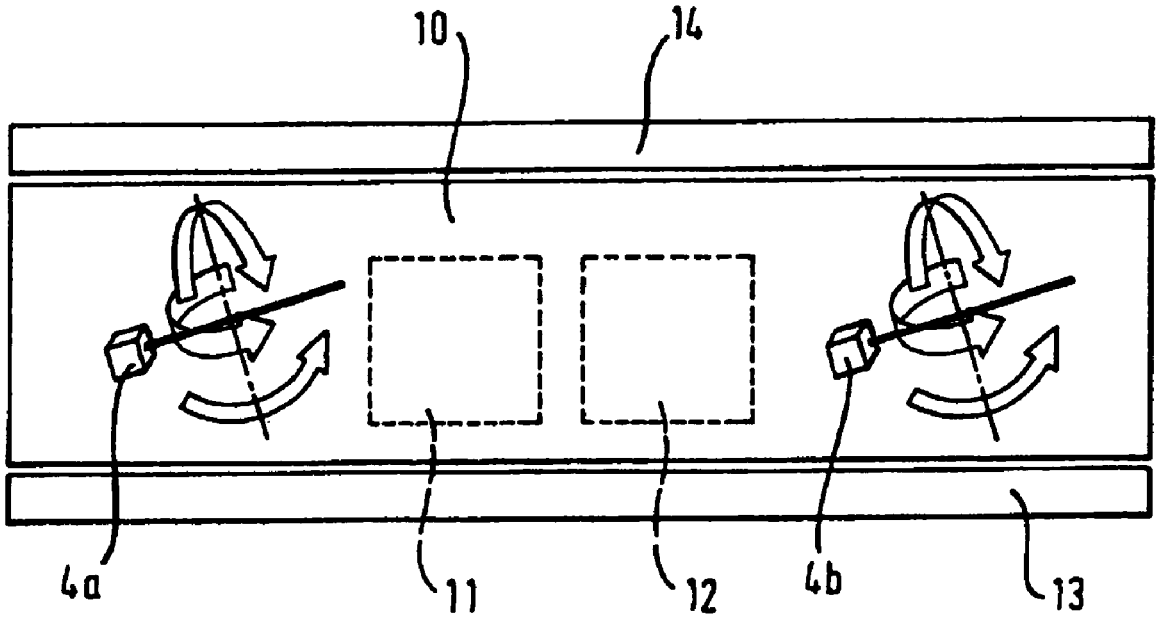
FIG. 5 is an alternative to the wiping device illustrated in FIGS. 3 and 4.

FIG. 5 illustrates an additional wiping device 10 with an inertial mass drive that is illustrated only symbolically here and that corresponds to the explanation to the FIGS. 3 and 4. An electronic control 11 with a microprocessor for the program control of the wiping device, a memory, an evaluator for the position sensors, acceleration sensors or collision sensors (not illustrated) arranged on the lateral edges of the wiping device 10 are also marked symbolically in the figure. Electronics monitoring the power are also drawn symbolically. The power electronics, marked with 12, controls the charging and discharging of electric batteries as well as the motorized drives of the inertial masses 4*a* and 4*b*. The electrical details of such a control system are apparent to those skilled in this art.

Furthermore, the wiping device 10 from FIG. 5 has on its lower side a wiping cloth 13 whose lower side forms the currently used wiping surface. Moreover, the wiping device 10 is illustrated here with an additional wiping cloth 14 on its upper side. This additional wiping cloth 14 is not used in the state illustrated in the figure. The wiping device 10 can thus be reversed either manually by the user or by a base station that is explained in the further course of this description in order to be able to continue wiping using the additional wiping cloth 14 in case the other wiping cloth is soiled or used. In the wiping device illustrated here, the numerical proportion of the edges in the projection with respect to the floor is approximately over 3:1. Thus it is possible firstly to clean narrow interspaces thoroughly and secondly to obtain effective path widths on large surfaces.

Figure 6:
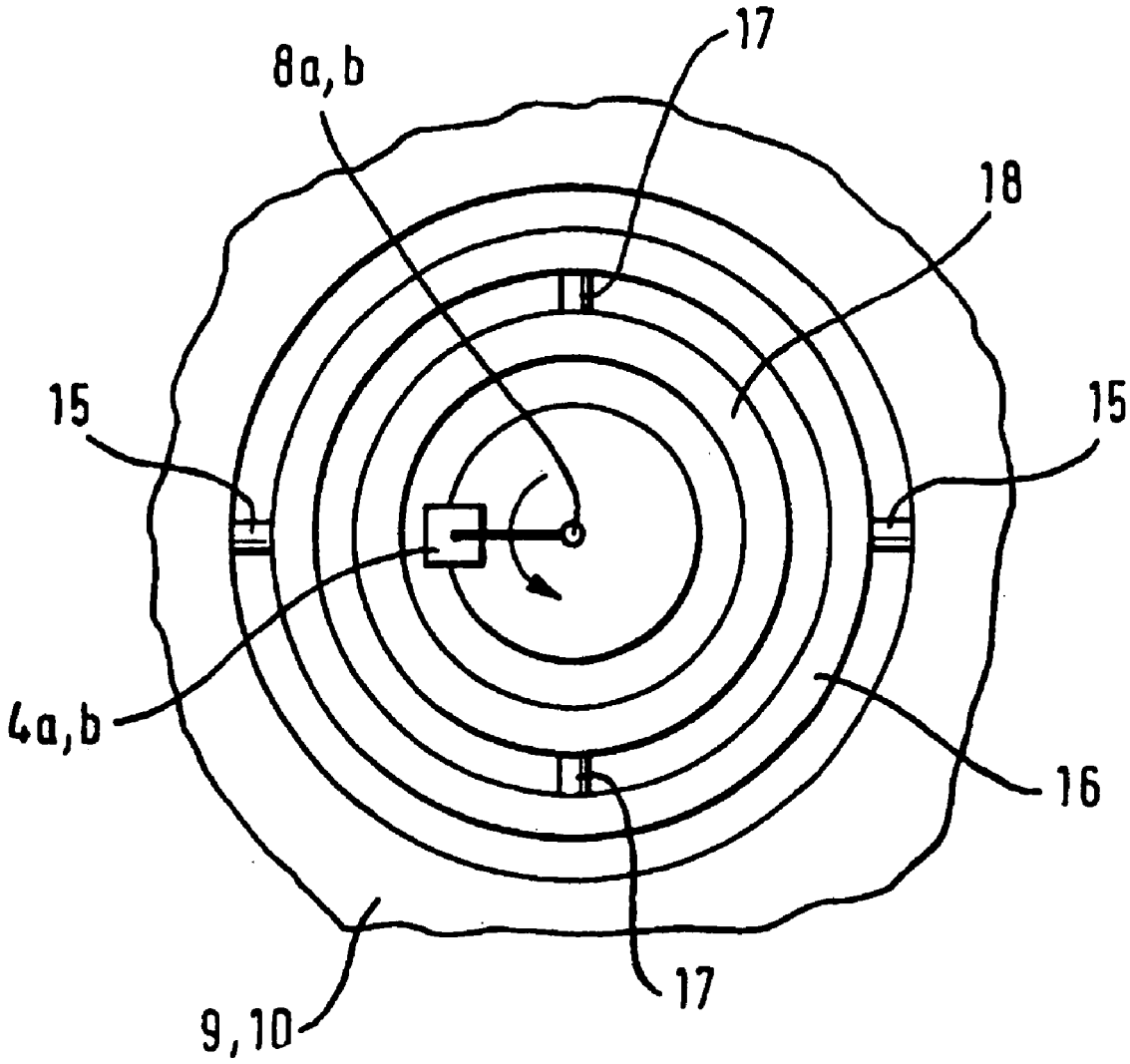
FIG. 6 is a single illustration for the FIGS. 3, 4, and 5.

FIG. 6 illustrates the top view of a gimbaled bearing of the inertial masses 4*a* and 4*b* illustrated in the FIGS. 3 to 5. The "fixed" base of the corresponding wiping device is indicated by 9 and 10. The line of view is directed from top toward the floor level. A first rotary axle 15 holds a first gimbaled ring 16 to which a second rotary axle 17 is affixed that is twisted by 90° with respect to the first rotary axle 15. The second rotary axle 17 holds a second gimbaled ring 18 on which the inertial mass 4*a* and/or 4*b* is mounted such that it rotates around the rotation axis 8*a* to 8*b*. The motorized drive of the inertial mass 4*a* and/or 4*b* takes place preferably using electric motors provided in the gimbaled bearing or even using flexible shafts that are guided using motors firmly attached to the base 9, 10. These motors are however not illustrated in the figure. The gimbaled bearing with the axles 15 and 17 can be adjusted by servo motors (also not illustrated) using a lever arrangement with levers that are attached on the rings 16, 18 on the rotary axles 15 and/or 17.

Consequent to the explanation regarding the preceding FIGS. 3 to 5, the wiping device 9, 10 can be adjusted by adjusting the rotation speeds and the rotation planes to different friction ratios of the respective wiping cloths or other wiping surfaces and different floors, even if the latter are direction-dependent. Particularly, the electronic control 11 can detect the timings of the movements of the wiping device 9, 10 and can strive by increasingly tipping the rotation planes, for a state in which the static friction is overcome only in certain phases. Moreover, due to the gimbaled bearing, the wiping device 9 and 10 can move in any horizontal direction. It is also possible to rotate the wiping device 9, 10 around a vertical axis by separately controlling the rotation planes and/or rotation phases of both the inertial masses 4*a* and 4*b*. When the wiping device 9, 10 is rotating around a vertical axis, the centrifugal forces of the inertial masses are directed opposite to one another if the maximum gravitation-reducing vertical component or the superimpositions with the gravitation are different on both sides. Naturally even arbitrary superimpositions are possible from rotary and translatory movements.

For an angular momentum drive, gyroscopes with a concentric center of gravity must be provided in FIG. 3 and in the following FIGS. instead of the eccentrically suspended inertial masses. Their angular momentum could be, for instance, lying substantially horizontally and could act in a direction that is vertical to angular momentum acting on the base by using a jerky change compared to the original position. This vertical angular momentum could rotate a part of the wiping device. If at the same time an angular momentum component in the horizontal direction provides for the loading of one end, this end could serve as the rotary axle for a swiveling movement of the wiping device. Consequently, an iterative movement is also possible using a reverse rotational direction and a loading on the corresponding other end of the wiping device.

The drives described here are all arranged inside and thus above the wiping surface.

Figure 7:
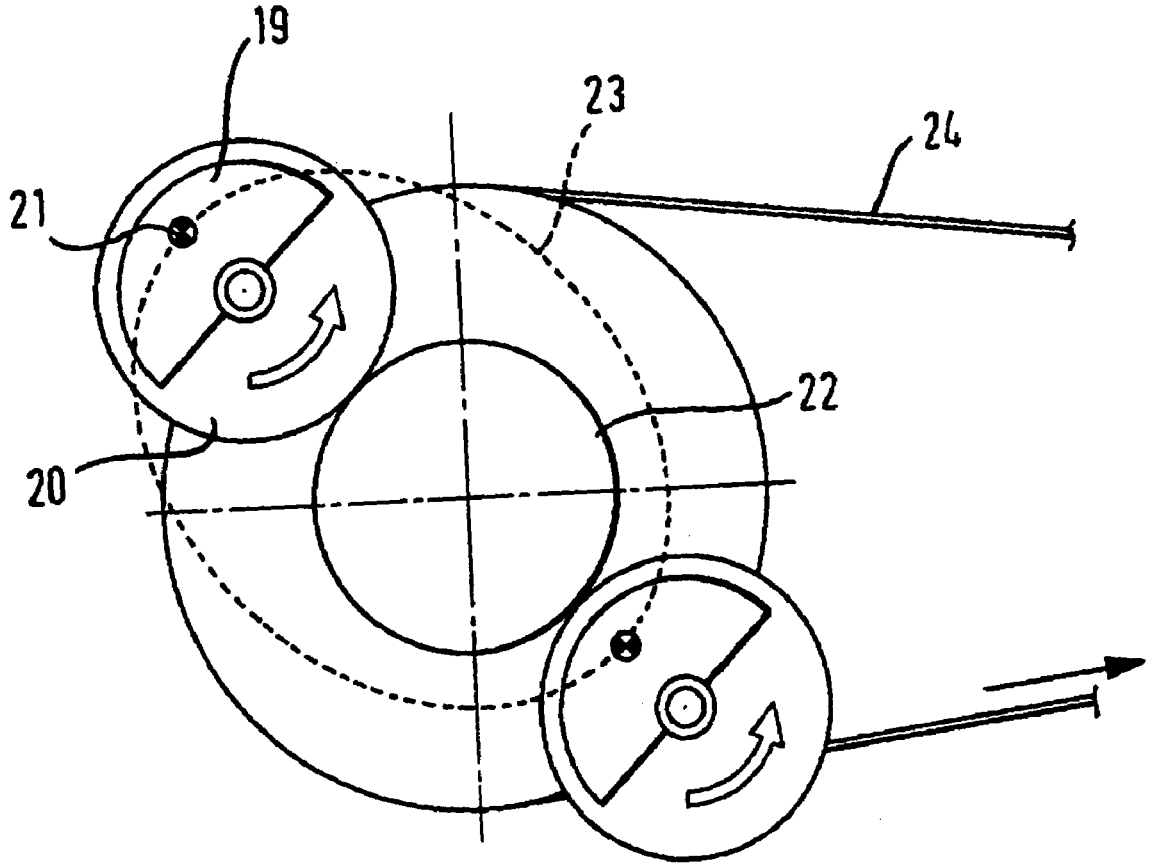
FIG. 7 is a schematic illustration of an additional alternative inertial mass drive.

FIG. 7 illustrates an additional rotary movement of an inertial mass 19. The inertial mass 19 is attached eccentrically in a planet wheel 20 wherein the center of gravity is indicated by 21. The planet wheel 20 runs on a stationary sun wheel 22 wherein the center of the planet wheel describes a circular path. However, the center of gravity 21 describes an elliptical path that is marked with the dashed line in the figure. In this case the rotary axle of the planet wheel is driven by a belt drive indicated by 24. This FIG. 7 serves only to explain the fact that even by using the path curve of the center of gravity of the inertial mass it is possible to achieve centrifugal forces of varying intensity at different points of time. In addition, the path movement and also the path speed of the inertial mass can be accelerated or decelerated. Moreover, the already mentioned options of the mutual compensation of inertial forces of two or more inertial masses are also possible.

As a result of aligning the longitudinal axis of the elliptical path illustrated in FIG. 7 it is possible to achieve using this drive an inertial drive even without tilting the path plane and using only one inertial mass 19.

Figure 8:
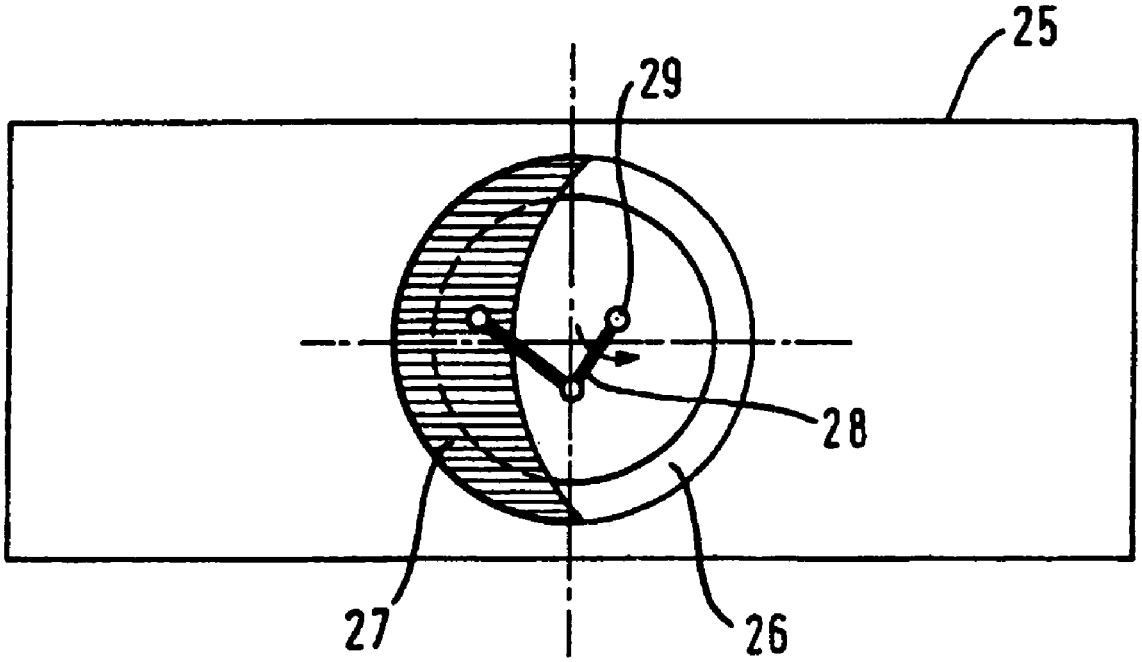
FIG. 8 is an additional schematic illustration of an alternative inertial mass drive.

FIG. 8 illustrates an additional example for a basic inertial mass drive. Here the top view of a wiping device is symbolically indicated by 25. In this FIG. a bearing 26 is provided in which an eccentric sickle-shaped inertial mass 27 is guided in a rotary manner. An assembly of levers (double crank with joint) 28 and a motor connected to point 29 can be used to move the inertial mass 27. This movement is uneven at uniform motor speed and accordingly also leads to an inertial drive of the wiping device 25 with sliding phases and static phases.

Figure 9:
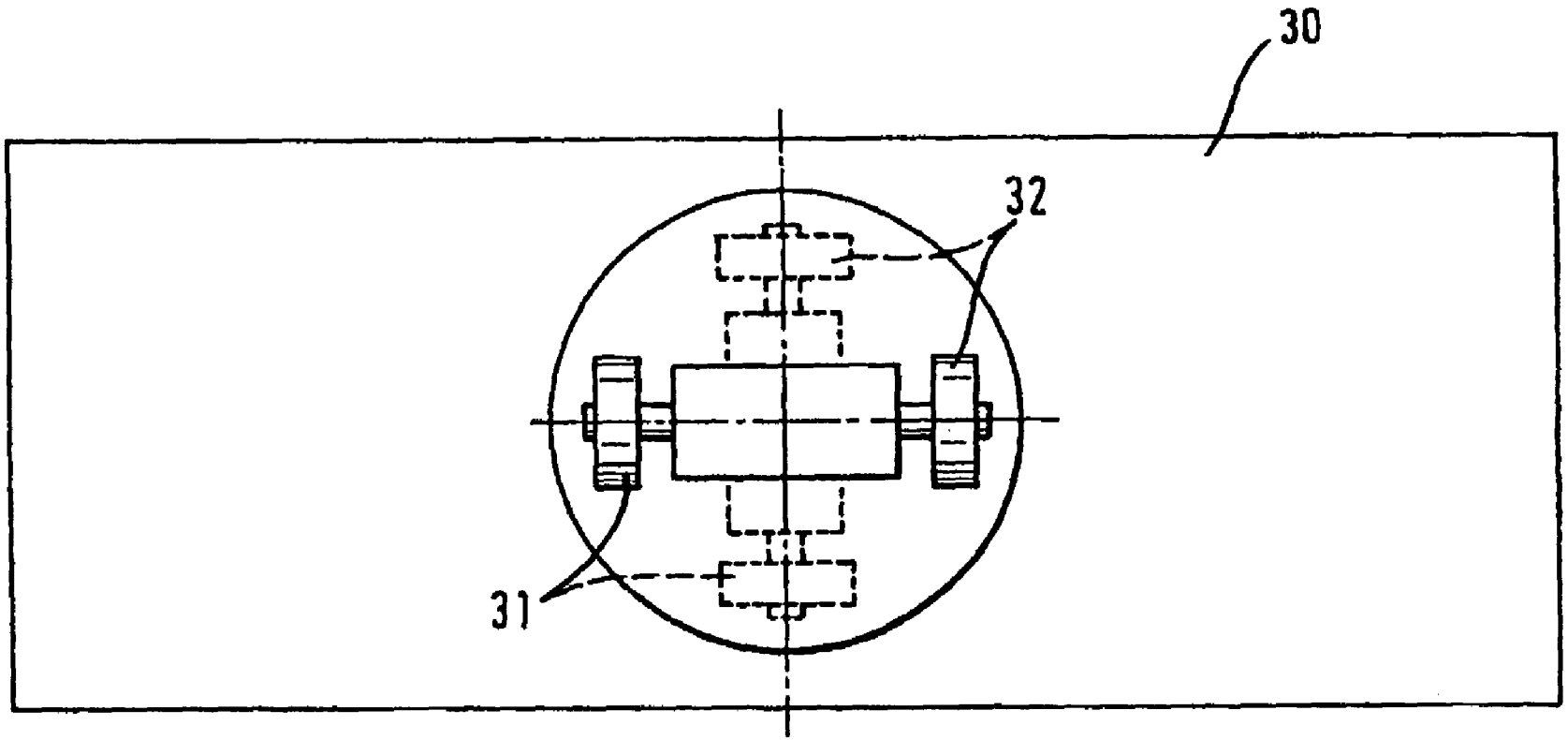
FIG. 9 is an example of a wheel drive.

FIG. 9 illustrates an alterative drive and thus not an embodiment for an inertial mass drive. Here, a wheel drive is arranged inside a wiping device 30 inside the wiping surface (corresponding to the top view of the wiping device 30 in FIG. 9). In this wheel drive two wheels 31 and 32 can be driven independent of one another and can be rotated opposite to the wiping device 30. The wheels, amounting to two altogether, are illustrated in two different positions. Using these two wheels the wiping device 30 can be transported with its wiping surface over the floor wherein arbitrary movement directions and also rotations of the wiping device 30 around its own axis are possible using the speed differences of the wheels 31 and 32 and the motorized adjustment of the angle of the rotary axles of the wheels 31 and 32 with respect to the wiping device 30. Here, it must be noted that the frictional connection between the wheels 31 and 32 and the floor is sufficiently high in relation to the sliding friction of the wiping surface on it.

FIG. 9 particularly illustrates that even in case of this drive an arrangement inside the wiping surface is possible and traces on the floor likely to be caused by the wheels 31 and 32 can be wiped away independent of the movement direction. That is to say, the drive is enclosed by the wiping surface.

Particularly in the context of the wheel drive it is possible to let the wiping surface swivel in a rotating or any other manner with respect to the drive for the purpose of increasing the mechanical cleaning action. An inertial mass can also be used for this purpose. Incidentally, the inertial mass drives can also be retrofitted appropriately in the different examples.

Figure 10:
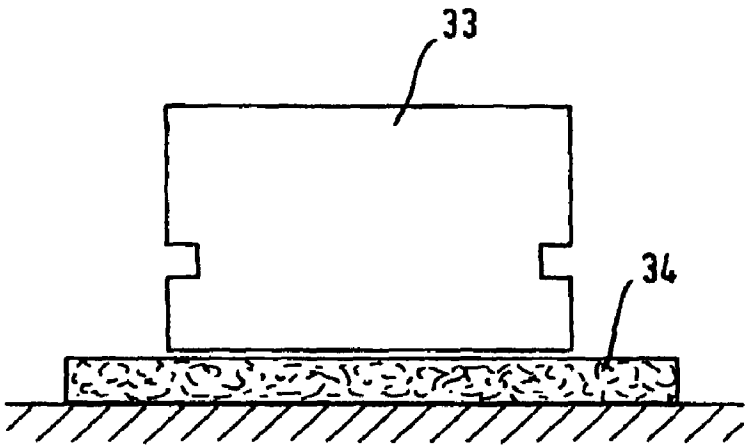
FIG. 10 is an illustration of the vertical section of a wiping device.

FIG. 10 illustrates a front view of a wiping device 33 that has a wiping cloth 34 that projects over the lateral edge of the actual wiping device 33. This wiping cloth 34 serves as a protection for the edge and restricts the dimensions of the projection of the wiping device 33 on the floor. Thus it is possible to wiping device efficiently particularly along edges of walls without the risk of damages resulting from hitting the wiping device 33 against obstructions. Naturally, the mops can also have corresponding contact protection edges independent of wiping cloths. These contact protection edges can also perform sensory functions in order to inform the already mentioned electronic control 11 about a collision with an obstacle.

Figure 11:
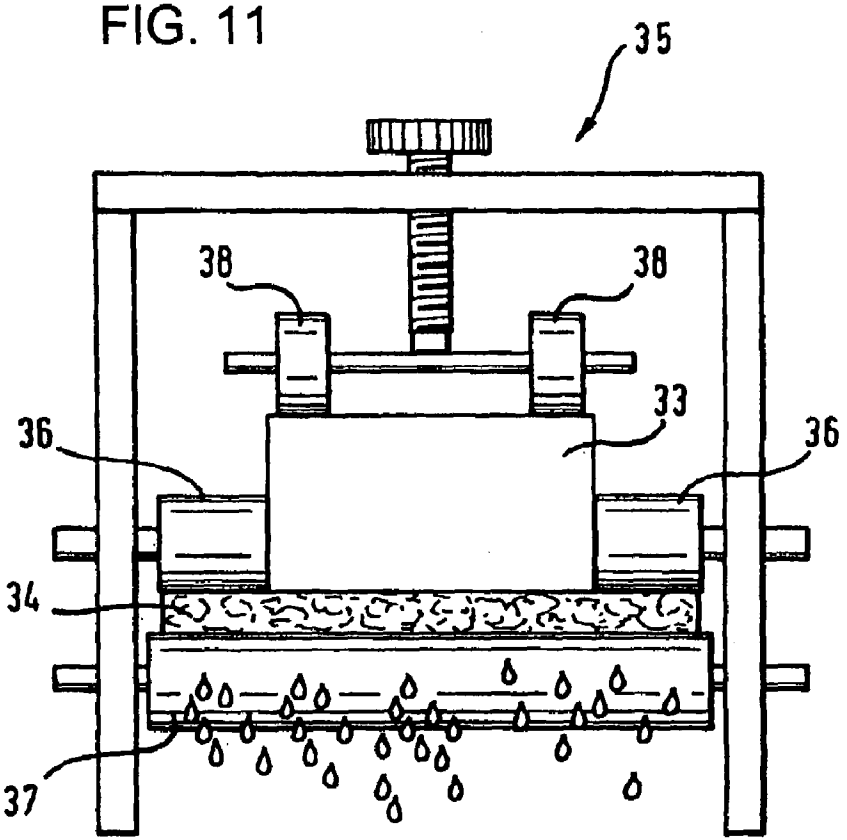
FIG. 11 is a schematic illustration of a base station pursuant to the invention.

FIG. 11 illustrates a schematic diagram of a cross-section illustrated in the line of view of FIG. 10 of a base station 35 for regenerating the wiping device 33. Here the wiping device 33 with its wiping cloth 34 is guided between wringing rollers 36, 37, 38. The distance between the wringing rollers 36 and 37 and or the wringing rollers 38 and 37 can be adjusted so as to appropriately determine the force with which the wiping cloth 34 is wrung out. Here, the wringing rollers 38 press the wiping device 33 and the wringing rollers 36 press the projecting edges of the wiping cloth 34 wherein the wringing rollers 37 form a counter bearing. The wrung out cleaning liquid flows downward as indicated in the figure.

Figure 12:
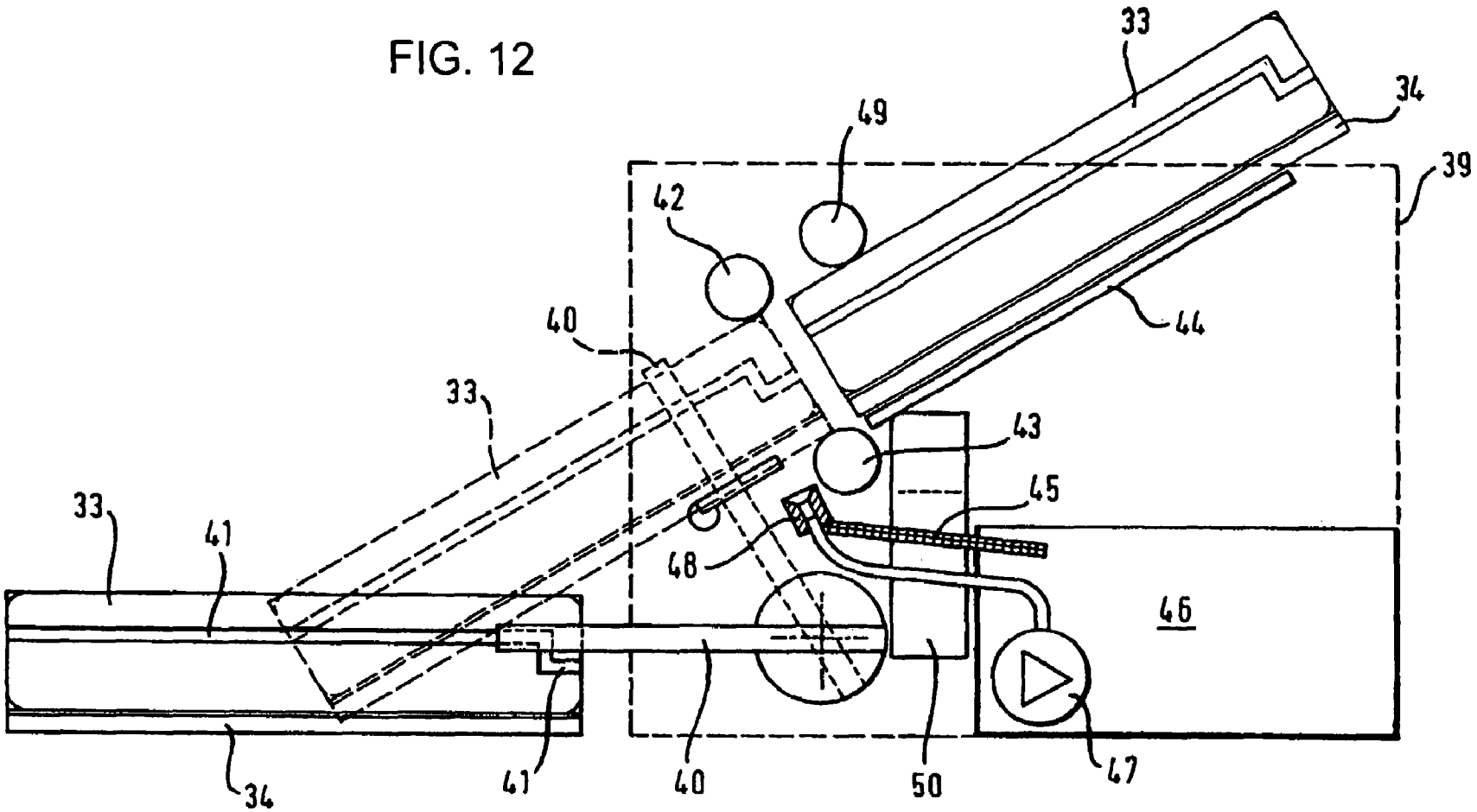
FIG. 12 is an exact illustration of the side view of a base part pursuant to the invention.

FIG. 12 illustrates a somewhat more concrete embodiment for the base station indicated here with 39. The wiping device 33 illustrated in FIG. 10 or also for example the wiping device 10 illustrated in FIG. 5 or the wiping device 9 illustrated in FIG. 3 can be moved into the position illustrated to the left in FIG. 12 by means of its own drive. There they are grasped by two levers 40 that can be tipped using motors in the manner illustrated. The spring-mounted pins that are explained subsequently in more detail are snapped into position behind undercuts in the grooves 41 illustrated in FIG. 12 on the respective front regions of the long sides of the wiping device 33. The levers 40 can thus grasp the wiping device 33 and lift it in a tipped manner as illustrated. In doing so, the front end of the wiping device 33 is guided between the wringing rollers 42 and 43. The wringing rollers 42 and 43 pull the wiping device 33 further upward in a tilted manner wherein the insertion pins get released from the snap-fit connections and extend further into the grooves 41 as a guide. In this manner the wiping device 33 can be transported on a tilted plane 44 wherein the wringing rollers 42 and 43 wring out the residual liquid present in the wiping cloth 34.

The draining cleaning liquid flows through a continuous flow filter 45 into a foul water container 46 from which the cleaning fluid that is cleaned accordingly by the filter 45 is fed by means of a pump 47 to a spray nozzle 48 that sprays the cleaning liquid on the wiping cloth 34 again for improving the cleaning action before the wringing out process and/or during the return movement of the wiping device 33. The transportation of the wiping device 33 is supported incidentally by an additional carrier roller 49. Apart from that, a fresh water container 50 is provided that contains clear water for rinsing, for instance, for a final wiping and can be connected to the spray nozzle 48 in a manner that is not illustrated in the figure. Furthermore, the cleaning system can first carry out a multiple wiping process i.e. a wet wiping or wiping process followed by a dry wiping or wiping process in the manner already described.

Due to the tilted movement of the wiping device 33 on the plane 44, the wiping device 33 can be transported easily with the help of motor-driven levers 40 in the base station 39. Thus the lower side and consequently the wiping cloth 34 of the wiping device 33 are accessible and space is created for the described components under the plane 44. The hydraulic unit on the continuous flow filter 45, the foul water container 46, the spray nozzle 48 and the fresh water container 50 are designed as a completely removable module.

Also the distances between the rollers 42 and 49 with respect to the rollers 43 are adjustable for the purpose of ensuring an optimum wringing out action and a sufficient frictional connection for the transportation of the wiping device. Thus, it is possible to adjust even the quantity of residual moisture in the cleaning cloth 34. The adjustment can be carried out using eccentric elements in the rotary axle bearings.

Figure 13:
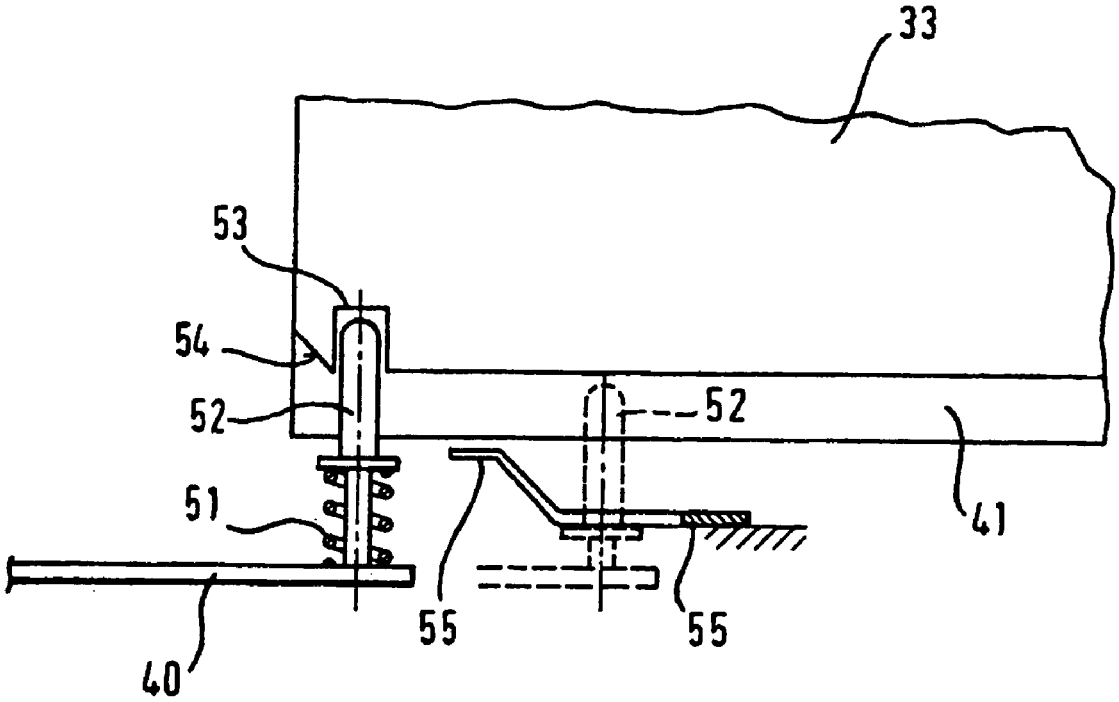
FIG. 13 is a single illustration for FIG. 12.

FIG. 13 illustrates the already mentioned snap-fit locking mechanism for grasping the wiping device 33 by the levers 40. The left lower side shows one of the two levers 40 that supports on its end a pin 52 that is mounted on a spring 51. It must be noted that the FIG. 13 is laterally reversed as opposed to FIG. 12. The already mentioned groove 41 has in its initial region, thus close to its right end (in FIG. 12) and left end (in FIG. 13) an undercut 53 in which the pin 52 can be snapped into position. The snap-fit connection is facilitated by a chamfer 54 at the start of the groove 41. The pin is disengaged from the undercut by either a similar chamfer with the help of forces applied by the wringing rollers 42 and 43 or with the help of an additional release mechanism that is indicated here by the motor-driven fork 55. This can grasp the pin 52 and pull it out of the undercut 53. Consequently, the pin 52 slides along the groove 41 as a guide.

Naturally, there are also additional alternatives of transporting the motor-driven wiping device 33 into a base station by gantries, cranes, elevators, chain drives, cable winches, etc. A base station can also be designed particularly for the purpose of rotating a wiping device with two wiping cloths (refer to FIG. 5) by 180°.

Figure 14:
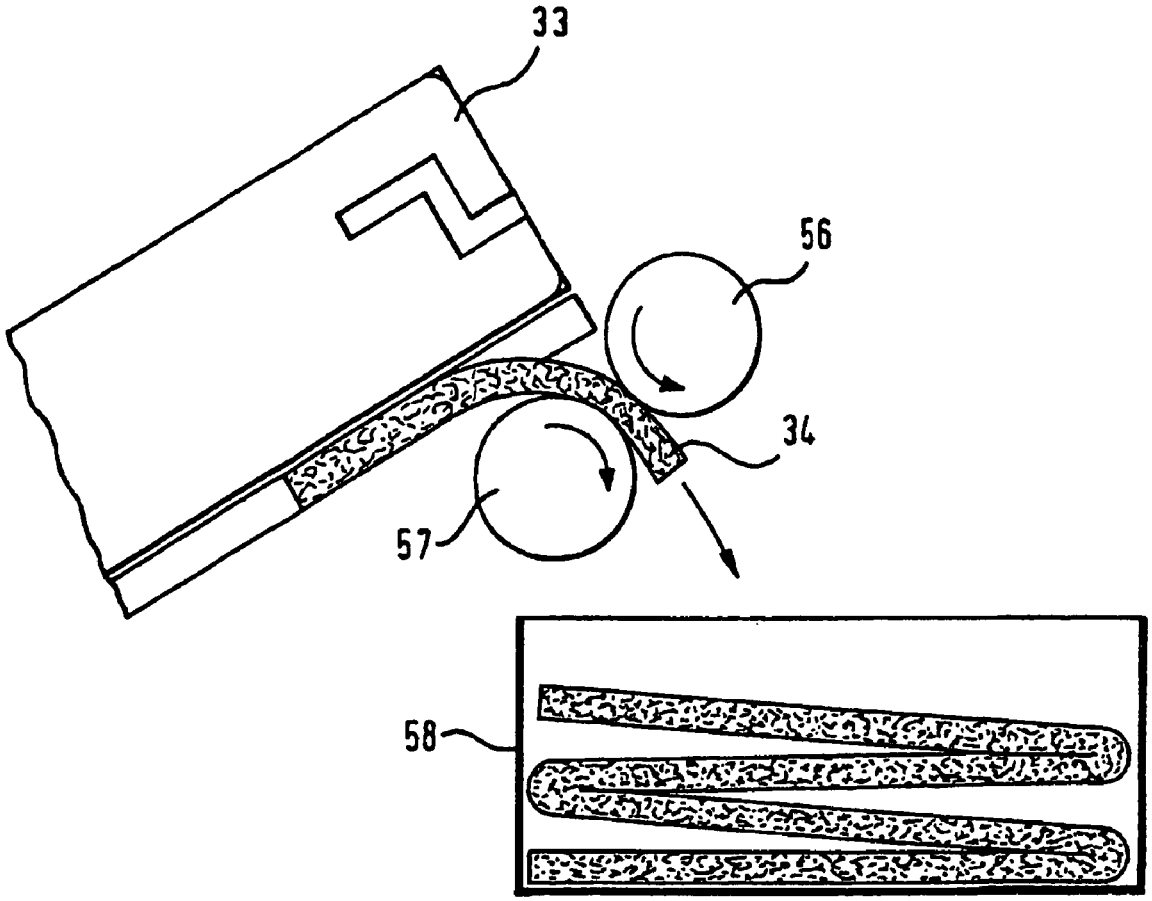
FIG. 14 is a schematic illustration of an additional detail of a base station pursuant to the invention.
Figure 15:
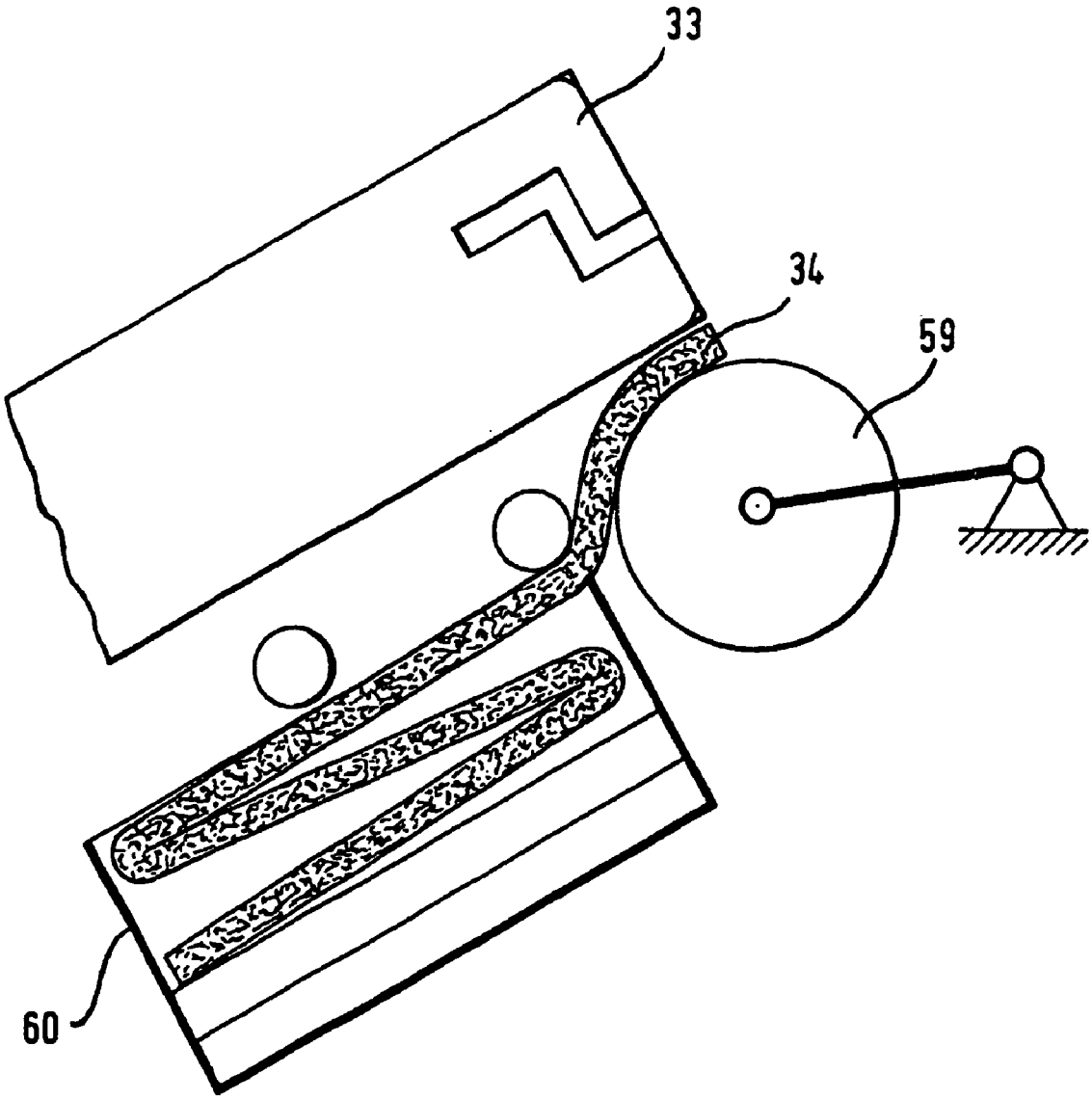
FIG. 15 is a schematic illustration of an additional detail of a base station pursuant to the invention.

FIG. 14 illustrates schematically that the base station 39, if necessary, can also be used in a second compartment for the purpose of replacing the wiping cloth 34. FIG. 14 shows how the wiping cloth 34 can be pulled out by two rollers 56 and 57 from Velcro® fasteners (not illustrated in detail) on the lower surface of the wiping device 33 and deposited in a container 58. Conversely, FIG. 15 shows how a fresh wiping cloth 34 can be removed from a container 60 by a pressing roller 59 and placed on the Velcro® fastener. In both the processes, the wiping device 33 is transported in a tilted direction similar to the explanation for FIG. 12. Also, a lever mechanism corresponding to the explanation of FIG. 12 can be used here.

The different motor-activated movement steps into the base station 39 can also be controlled by light barriers or similar sensors. However, as soon as the wiping device 33 is grasped, the typical current propagation of the electric motors involved can also be used in order to draw conclusions regarding the respective movement phases.

Apart from that, as has been mentioned previously, optical evaluations of the degree of soiling of the floor, the wiping cloth, the cleaning liquid in the wiping cloth or also in the container 46, the degree of soiling of the filter 45, etc. can also be used.

Furthermore, a base station 39 can be programmed in order to enter data regarding residual liquid, cleaning cycles, wiping cloth data, etc. Incidentally, wiping cloths can also contain transponders that can be read out in the base station. The electronic control 11 of the wiping device that can, if necessary also be reprogrammed using an electronic control of the base station, can control the wiping device (in its concrete design) allowing for known data or data that are determined during previous trips of room dimensions and floor characteristics. Even the user can state the rooms to be cleaned and thus call up known data sets and/or enter substantial characteristics of such rooms. Incidentally, the wiping device can determine its position automatically using known odometric processes. This is possible by determining the movement distances and movement directions and consequently the current positions. The position can be determined even using other methods, for instance, using laser based measuring systems.

The wiping trips are preferably S-shaped with preferably the same longitudinal edges located at the front. It is thus possible to clean large surfaces with few trips and less overlapping of the covered path widths. The already described movement of the wiping device with the same edge located at the front prevents streaks of dirt from depositing in the curves or corners.

One unit system has a base station with a motor-driven transport device that is designed for the purpose of transporting the mobile wiping device for regeneration into and out of the base station.

The present description also refers particularly to a process for wiping floors. In the following description, however, the aspects of the device and the process are not differentiated from one another in detail so as to facilitate the understanding and intelligibility of the entire disclosure with respect to both categories.

The basic principle involves equipping the base station with a motorized device for the purpose of transporting the mobile wiping device in and out although even the latter is motor-driven. In contrast to conventional units in which the mobile wiping device moves with the help of its drive toward the base station and "parks," for instance, on or below corresponding connections for regeneration, the base station is provided with an independent motorized mechanism—the transport device. Using the transport device the mobile wiping device can be brought into a definite position without requiring the mobile wiping device to do so using its own drive. For instance, the transport device of the base station can also lift the mobile wiping device, which the drive of the mobile wiping device in many cases is incapable of. Incidentally, if desired or required, the transport device in the base station can apply relatively large forces, which the motorized drive of the mobile wiping device that is provided, for instance, with an electric battery, etc. cannot apply or can apply only in case of a generous and hence unnecessary layout of this drive.

The mobile wiping device preferably has a wiping cloth with which it mops the floor for cleaning or for other purposes. The regenerating process involves cleaning the wiping cloth or replacing the wiping cloth with a clean or a new wiping cloth. The term "wiping cloth" is to be understood as having a very general meaning here and can include all possible fiber-based flat products with which a floor can be mopped. Thus it can be non-woven materials, cloth, furry or papery textiles, etc.

The base station preferably contains a tilted plane on which the regeneration of the mobile wiping device takes place and on which the transport device brings the wiping device for the purpose of regeneration. The tilted plane can ensure a better accessibility to the lower side of the mobile wiping device and thus can facilitate the cleaning or replacing of a wiping cloth or any other type of regeneration.

The motor-driven transport device of the base station contains at least one, or preferably two, levers that are designed for the purpose of grasping the mobile wiping device. The grasped mobile wiping device is then pulled into or lifted into the base station by the levers.

The lever or both the levers are preferably provided with a mechanism that snaps into position on appropriately designed grips of the mobile wiping device if it is grasped by the levers. In doing so, the snap-fit connection should preferably by released again in the further course of the transport of the mobile wiping device into the base station, wherein the levers can be used even after releasing the snap-fit connection to guide the transport process into the base station.

For instance, the snap-fit locking mechanism can be a spring-mounted pin coupler. The coupling pins can fit behind a corresponding grip and snap into position on an undercut. The coupling pins are preferably arranged on the levers and the grip with the undercut is preferably arranged on the mobile wiping device. The spring-mounted coupling pins can be released from the snap-fit connection by an additional mechanical device in the base station or even by a tilted plane on the device of the base station with the undercut over which the pins can run up during the exertion of appropriately directed forces. Consequently, the pins can for instance extend along into a groove without an additional undercut in order to serve as a guide.

The base station cleans the mobile wiping device preferably by guiding it by means of a wringing roller that wrings out the cleaning liquid still contained in the wiping cloth or the cleaning liquid that is applied beforehand for cleaning the wiping cloth so as to remove the dirt attached to it. Similarly, this also applies to the process of wringing out the treatment liquids that are not used for cleaning purposes. The wringing roller is pressed preferably using adjustable pressure on the mobile wiping device. The wringing roller can be mounted eccentrically or the guiding devices for the mobile wiping device opposite to the wringing roller can be adjusted.

Furthermore, it is preferred to moisten the wiping cloth again after the wringing out process using a cleaning liquid or any other liquid. A preferred embodiment of the present invention uses a cleaning liquid that is recycled in the base station, and thus was already wrung out at a previous point in time. Here, the base station can have a filter, particularly a continuous flow filter for the cleaning liquid.

The new moistening process can firstly be used to repeat and improve the cleaning process by a new wringing out process.

Secondly it is preferable to moisten or to actually wet the wiping cloth slightly before a new wiping of the floor. It is particularly preferred if the unit can also execute a second or a multi-level wiping process in that the mobile wiping device first wet mops the floor and consequently absorbs the liquid still present on the floor by dry wiping or wiping it.

Apart from that, the base station can be provided with an additional device that enables the wiping cloth to be replaced by pulling it off from an adhesive fastener (so-called Velcro® fastener, or comparable) on the mobile wiping device. Subsequently, the wiping process continues with a new and/or clean wiping cloth that is placed again on the adhesive fastener. In this embodiment, the base station is capable of performing this function automatically.

In the unit, the degree of soiling of the floor to be cleaned, the wiping cloth used, the cleaning liquid in the base station and/or the degree of soiling of the filter for the cleaning liquid can be measured and monitored preferably using optical and/or opto-electronic means.

The present invention also relates to the mobile wiping device for wiping flat surfaces in which the drive is located within a path width covered by the wiping surface when the device moves using the drive.

Thus in this embodiment the drive is arranged within a path width covered by the wiping process. This particularly means that the drive does not interfere outside the path width covered in the wiping process if, for instance, a wiping action is necessary just alongside an edge of the floor. Here, the invention enables the wiping surface to come within a relatively small distance to this edge or to wiping device without any such distance because the drive, for instance a wheel running between the path width covered by the wiping process and the floor edge as a drive component, is arranged within the covered path width.

In doing so, the drive lies substantially above the surface to be mopped. The drive is arranged preferably over the wiping surface. In principle, however, it can be arranged in the movement direction in front of or behind the wiping surface as long as it remains within the path width.

Thus it is possible to provide a relatively broad wiping surface proportionate to the overall size of the device that is substantially also determined by the drive.

The wiping device preferably has narrow and long outer dimensions like a projection on the surface to be mopped, thus a clearly larger expansion in one direction than in a second direction extending vertically to the former. The numerical proportion of the dimensions of the longest and the narrowest side preferably amounts to at least 2:1, better at least 2.5:1 and in the most favorable case at least 3:1. A preferred basic shape of the projection of the wiping device on the surface to be mopped is a narrow long rectangle. Narrow long outer dimensions enable a relatively large path width even in case of a device that is not too large. The wiping device can particularly be inserted very flexibly while moving through narrow passages or while wiping small corners.

Moreover, it is preferred if the said outer dimensions of the wiping device are dependent on the wiping surface. Thus, the wiping surface at the level of the surface to be mopped forms the edges of the device or at least substantially corresponds to them. A replaceable wiping device cover can be optionally arranged such that it projects on one or more sides over the remaining parts of the wiping device. This arrangement firstly enables a particularly good wiping process along floor edges and secondly forms a protective contact edge. Naturally even additional contact edges can be provided that are not formed by the wiping surface itself.

Also contact edges that are equipped with sensory characteristics can be provided in order to point out a collision with an obstacle to an automatic control of the wiping device and thus to call forth corresponding control reactions.

The wiping device moves preferably forward in its operation in such a manner that during a wiping movement one and the same long side points to the front. Thus the wiping action proceeds firstly with the maximum path width possible and secondly the dirt scooped together during the cleaning process is shifted in front of the wiping device. This preferably applies during and even after movements in corners around curves so that the wiping device does not leave behind any wiping device streaks in corners or around curves. For instance, the wiping device can first move in a rectangular corner of a floor with the said long side until the impact on the opposite edge, then move back, rotate by 90° in the sense of the future movement direction (so that the described long side now points toward the front in the future movement direction), move in this rotated position along the edge again into the corner in order to then move out of the corner and further in the new movement direction. In doing so, the wiping device moves into the corner with its long side lying in front, then out of the corner with the same long side lying in front and into the new movement direction.

Moreover, the wiping surface can be arranged such that it moves in its operation in an oscillating manner as opposed to the remaining part of the wiping device. For instance, the wiping surface can swing or circle as opposed to the base of the wiping device in one or in two (horizontal or vertical) directions. Thus the mechanical action on the floor can be increased without having to cross the same path repeatedly.

In another embodiment of the invention the wiping device is equipped with a wiping surface not on one side but on two opposite sides. The device can then by turned automatically or manually by the intervention of a user in order to be able to move further using the second wiping surface.

Incidentally, the wiping surface is preferably continuous, thus forming a contiguous surface in the mathematical sense. In addition, it is closed preferably in the movement direction behind the parts of the drive that touch the floor so that no traces are left by wheels, drive belts, etc. Such wheels or belts are thus preferably provided inside the wiping surface or in front of and/or a part of the wiping surface in the sense of the movement direction.

Moreover, an improved drive is provided for moving the wiping device over a surface comprising a motor-driven inertial mass that moves with respect to the base of the wiping device and is designed for the purpose of driving the wiping device by moving the inertial mass with respect to the base. For this purpose, during a part of these movements the static friction holding the wiping device on the surface is overcome by mass inertia of the inertial mass and not during other parts, wherein the movements of the inertial mass are iterative with respect to the base.

In the inertial mass drive, mass inertial forces are utilized that result due to the relative movements between an inertial mass and a base forming the stationary part of the wiping device to a certain extent. These mass inertial forces in definite phases result in overcoming the static friction that retains the wiping device on the surface on which it is supposed to move. In other phases, however, the mass inertial forces do not overcome the static friction. The following description discusses movement phases and static phases for purposes of simplification. Depending on the frame, the movements of the inertial mass thus transfer inertial forces onto the base. These inertial forces partly move the base and partly let it adhere to the surface. In other words, the movements of the inertial mass lead to a reaction of the base since the complete system strives to correspond to the momentum conservation. However, the momentum conservation is disturbed by the friction between the wiping device and the surface. In the static phases the base remains on the surface. In the movement phases it executes a preferably sliding or slipping movement on the surface. However, the base can also execute a rolling movement during the movement phases in case of corresponding static friction in the static phases in the wheel bearings or between the wheel surfaces and the surface.

The fact that the movements of the inertial mass are iterative with respect to the base, hence repetitive and thus enabling a continued movement, creates a drive concept on the whole that requires no direct form-fit or frictional (form-locking or force-locking) connection between drive components and the surface on which the wiping device is supposed to move.

In doing so, it is particularly possible for the wiping device to contact the surface to be mopped exclusively with its wiping surface because no wheels, drive belt, etc. have to be used.

For purposes of clarification, it is pointed out here that the inertial mass is a wiping device component and is not supposed to be used by the drive concept. Indeed, an energy coupling will be required for generating this movement. However, the inertial mass is supposed to remain unchanged as such as opposed to repulsion drives such as, for instance, rocket drives or jet drives.

Thus a sliding or rolling continuous movement is provided without coupling between the drive and the transport surface. This is preferable, for instance, if it is very difficult to create a form-fit connection or a frictional (form-locking or force-locking) connection with the transport surface, for instance, on completely smooth surfaces or if a contact between the drive of the cleaning device and the surface is not desired.

There are various basic options of the type of the movement between the inertial mass and the base. Firstly linear movements are possible in which the inertial mass is moved to and fro iteratively. In doing so appropriately strong accelerations or decelerations can generate inertial forces that lie over a threshold determined by the static friction. In case of smaller accelerations and decelerations, the wiping device remains within the static friction limits so that the inertial mass can be guided back for the benefit of a new movement phase of the wiping device.

In this context, it is particularly preferable to provide, in addition to the actual motorized drive of the inertial mass, energy storage particularly a mechanical spring that is loaded with energy and unloaded during the linear movements of the inertial mass synchronous to these movements. Due to this, firstly, at least parts of the energy spent by the motorized drive can be recovered. Secondly, the energy storage can use appropriately large forces to facilitate the acceleration phase provided for overcoming the static friction and the motorized drive itself can be used only for the purpose of return. Thus the drive could press the inertial mass against the spring force and in doing so can stress the spring. Subsequently, the drive is switched off and the spring is able to accelerate the inertial mass with relatively large forces.

Furthermore, even rotary or preferably circular movements between the inertial mass and the base are possible. In the rotary movements and particularly during the circular movements two cases are possible that could basically occur even in a combined form. Firstly, it is possible to utilize the actual momentum conservation in the sense of the linear momentum, and thus within the meaning of the centrifugal forces. Secondly, however, even the angular momentum conservation can be utilized in which the base experiences an angular momentum if the angular momentum of the inertial mass is changed. In the case of the linear momentum conservation, the inertial mass is arranged eccentrically with respect to the rotary movement. In the case of the angular momentum conservation, the inertial mass lies concentrically with respect to the rotary self-rotation. Here in each case the term "inertial mass" refers to its center of gravity and not necessarily to its physical form. Thus in the first case, for instance, an increased acceleration of the inertial mass could be utilized in definite path regions, for instance in non-circular paths, such as sun wheel paths or planet wheel paths.

In contrast, in the second case, for instance, in case of the change of direction of a concentric rotation of the inertial mass the angular momentum acting on the base could be utilized. In both cases, to put it clearly, a "jerk" can be created on the base that overcomes the static friction for a definite movement phase.

It is preferred, though not urgently required, that the movement phases, i.e. the "jerky movements" of the base generated by the inertial masses are always in the same direction (also in the sense of rotary movements). In principle, even cases are possible in which the static friction even within the context of "regresses" is overcome that altogether however lead to a smaller backward movement than the desired forward movement. Thus for instance, the inertial mass drive could also briefly overcome the static friction limit in case of inertial forces that are basically taking effect in the wrong direction. Overcoming the static friction limit in the desired direction for a longer period of time or at a greater speed does not stand in the way of a continuous movement.

It is also particularly preferable to use components of the utilized inertial forces for the purpose of utilizing the static friction between the wiping device and the surface on which it is supposed to move. Due to the corresponding layout of the movements, particularly their inclination, the wiping device can become heavier or lighter from time to time and probably also in places. To put it accurately, the wiping device can be pressed by corresponding inertial forces on the surface or relieved of its gravitational force. Due to this, in addition to or as an alternative to the already mentioned use of particularly large inertial forces in definite movement phases, it is possible to differentiate between movement phases and static phases. For instance, inertial forces that remain constant in terms of value in the movement phases can lead to a sliding of the device due to the components opposite to the gravitational force and in static phases can lead to a state of static adhesion due to components acting parallel to the gravitational force.

The use of at least two inertial masses is also particularly preferred in the above context. In addition to the aforementioned aspects, this allows for a skilled combination of the respective inertial forces and phase-wise addition and/or compensation. For instance, two inertial masses that have moved in a circular manner and having eccentric centers of gravity can move in the opposite direction and synchronously so that their inertial forces get compensated twice during each complete rotation and add up twice during each complete rotation. By the additional tilting of the rotation planes in the phases of the addition, inertial force components can be created that are parallel to the gravitational force in one case and antiparallel to the gravitational force in the other case. As a result the wiping device moves only or at least with stronger jerks in the case last mentioned.

In case of rotary components, the inertial masses are preferably gimbal-mounted on the base. This can serve for the tilting of the rotation planes in the context just described. Furthermore, the corresponding adjustment of the gimbaled suspensions as opposed to a stationary unchanged tilting also results in an adjustment to the magnitude of the static friction between the wiping device and the surface and in addition even a probably necessary compensation of direction dependencies of this static friction, for instance, in case of aligned wiping cloths. The gimbaled suspension can be adjusted preferably using motors and even automatically in that the wiping device tests the start of the movement phase to a certain extent and adjusts itself in case of given rotation movements by adjusting the tilting automatically to an optimum drive.

In the case of an inertial mass drive, by utilizing the conservation of linear momentum, thus also the centrifugal forces, the wiping device moves preferably over the surface step by step with translatory single steps in case of targeted straight movements of the wiping device. As opposed to that, in the utilization of the angular momentum conservation it is possible to utilize an angular momentum conservation component acting on the base in that one end of the wiping device serves as the rotary axle to a certain extent and it is "weighed down" by an angular momentum conservation component that is parallel to the surface and is acting on the base. In the next step an opposite end of the wiping device can be used as the rotary axle and an angular momentum that acts in the opposite direction and on the base momentum conservation component can be used for a corresponding second step, i.e. a component vertical to the surface can be used for a corresponding second step. In this case the wiping device would continue to move, for instance, alternating a right and a left side step by step and in doing so would turn around the other side in each case. The angular momentum components can be created either by tilting rotating gyroscopes or by accelerating or decelerating such gyroscopes. However the latter option is less preferred.

Incidentally, the device does not have to be necessarily free from other drive or steering influences. For instance, in the case of the preferred use as a cleaning device the arrangement can also enable an operator to influence the movement, for instance, by attaching a handle for steering or supporting the movement. A motor-driven mobile mop with a handle would firstly make it easier for cleaning personnel to push the mobile mop over the surface to be cleaned and secondly the mobile mop could be additionally much heavier and more capable of more efficient cleaning action than a conventional manually operated mobile mop. However an autarkic and automatically moving cleaning device with the described inertial mass drive is preferred.

Figure 16:
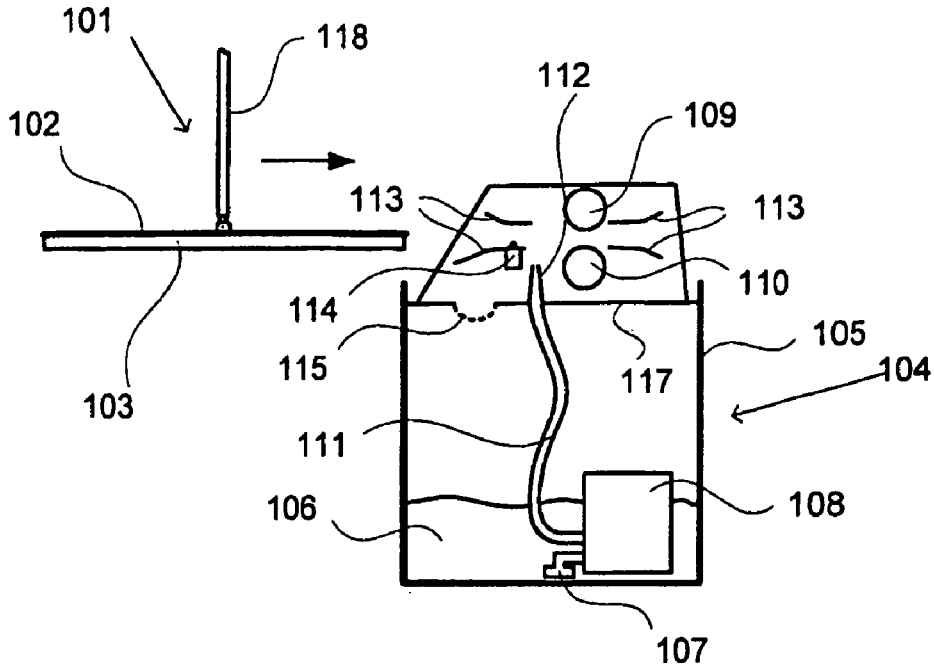
FIG. 16 is a schematic illustration of a side view of a device pursuant to the invention for moistening a wet wiping device or mop together with a mop pursuant to the invention.

FIG. 16 illustrates schematically a device 104 for moistening a wet wiping device, referred to below as a mop 101. The mop 101 has a holder 102 attached to a handle 118 for holding a mop cover 103. The mop cover 103 is flexible and absorbent so that it can be moistened for the purpose of cleaning floors with a cleaning liquid.

For the purpose of moistening the mop cover, the mop 101 is guided in the direction of the arrow by the device 104 through a guide 113 that has individual guiding elements in the form of horizontally arranged sheet plates. The guide 113 guides the holder 102 horizontally along a movement path using a spray nozzle 112. The spray nozzle 112 is connected by means of a liquid line 111 to a pump 108 that is arranged down on the bottom of a container 105 that forms the base of the device 104. The container 105 contains a cleaning liquid 106 that is sucked from the pump 108 using an inlet filter 107 and can be pumped by the line 111 to the spray nozzle 112. The spray nozzle 112 sprays the liquid 106 from below against the mop cover 103 of the mop 101.

A sensor 114, for instance, in the form of a switch is provided in the guide 113. The sensor records the presence of the holder 102 in the guide 113. As soon as the holder 102 is inserted into the guide 113 and this is recorded by the sensor 114 a control (not illustrated) controls the pump 108 so that a spray nozzle 112 sprays the liquid 106 upward. At the same time a motor-driven drive roller 110 is controlled that is arranged below the movement path. Two counter rollers 109 are arranged on the side of the movement path that lies opposite to the drive roller 110. The counter rollers are arranged coaxially to one another and can rotate around a rotary axle that is parallel to the rotary axle of the drive roller 110. The holder 102 can thus be pulled together with the mop cover 103 between the drive roller 110 and the counter rollers 109.

The distance between the drive roller 110 and the counter rollers 109 is dimensioned such that the holder 102 with the mop cover 103 forms a friction fit with the rollers 109, 110 so that it can be gripped and driven in a drive device.

Figure 17:
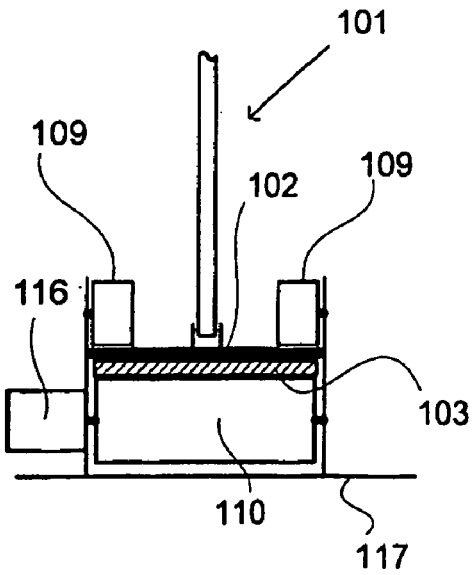
FIG. 17 is an enlarged partial view from the front of the device in accordance with FIG. 16 together with the mop.

FIG. 17 illustrates the part of the device 104 for wringing out the mop cover 103 in an enlarged form from the front. The drive roller 110 stretches over the entire width of the mop cover 103 vertically to the drive direction so that it rests against the mop cover 103 on the lower side covering its entire width. Both the counter rollers 109 are arranged over the edges of the holder 102 in the extension of the width of the holder 102 and leave an interspace open between them. The interspace between the rollers 109 is used for guiding the handle 18 of the mop through said interspace.

Figure 18:
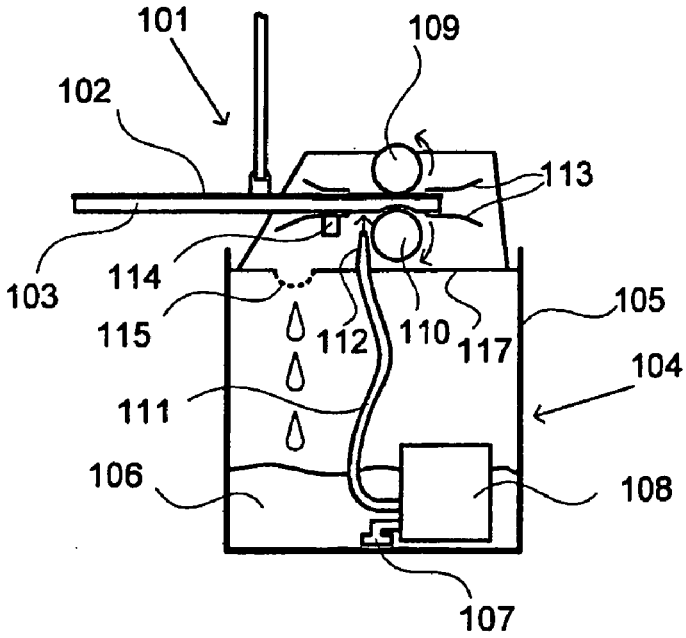
FIG. 18 is a side view of the device in accordance with FIG. 16 during operation of the device for moistening and wringing out the mop.

As has been illustrated in FIG. 18, due to the pressure of the drive roller 110 the mop cover 103 is dried in part and/or liquid is wrung out of the mop cover 103. The wrung out liquid 106 flows on an intermediate floor 117 and from there through a dirt filter 115 back into the container 105. In the process of guiding the mop 101 through the guide 113 as has been illustrated in FIG. 18, the mop cover 103 is sprayed from below with the cleaning liquid 106 so that the mop cover 103 can be moistened and the dirt particles present in it can be rinsed out. The mop cover is subsequently dried in part so that it discharges a definite quantity of moisture on the right side of the device 104. As a result the mop cover 103 does not trickle while cleaning. The control also records when the holder 102 releases the sensor 114 and/or when the rear end of the holder 102 has passed the sensor 114 and then controls the pump 108 and the drive roller 110 for a definite period of time until the holder 102 is completely pulled through the rollers 109, 110. The control process of the pump 108 can be ended even before the control process of the rollers 109, 110.

FIGS. 19 to 22 illustrate different embodiments of the mop 101 pursuant to the present invention. Its holder 102 has a flat core 119 on whose edge an edge trim 120 is arranged. The edge trim 120 can stretch in all embodiments around the entire periphery of the core 119.

In all the embodiments described, the core 119 can be formed by a metal plate. Its thickness and the material characteristics depend on the forces acting on the holder 102 during the wringing out process of the mop cover 103. These forces in turn depend upon the design of the device 104. Furthermore, the core material is selected such that it is resistant to the liquids and/or cleaning agents used while cleaning. This applies at least to the sections of the core 119 that come into contact with the related cleaning agents. Here, the core 119 can also be provided with a protective layer.

Figure 19:
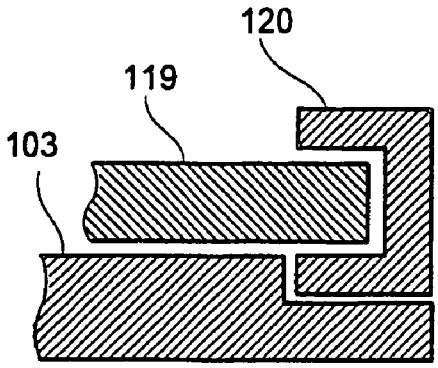
FIG. 19–21 is a sectional view of five embodiments of the mop pursuant to the invention with a soft edge trim.

FIG. 19 illustrates the cross section of a holder of an embodiment of the mop pursuant to the invention. The edge trim 120 comprises in this case a U-profile and is attached with its open side on the edge of the core 119. The U-profile of the edge trim 120 is arranged such that it clamps on the edge of the core 119 in order to let no gap or only a very small gap between the core 119 and the edge trim. The edge trim 120 surrounds the edge of the core 119 completely so as to stretch over the entire periphery of the edge of the core 119. In doing so the edge trim 120 can be fitted as a profile wherein however a joint in the edge trim 120 is usually unavoidable.

In an advantageous embodiment of the invention the edge trim 120 can be designed directly on the edge of the core 119. This creates a better connection and a narrower gap between the core 119 and the edge trim 120 and thus it is possible to achieve a seamless edge trim 120. For this purpose the core 119 can be injection-molded with the edge trim 120 if it tolerates the basic material of the edge trim 120. Moreover, the edge trim 120 can also be applied on top by dipping the edge of the core 119 into the corresponding liquid material that later hardens and/or solidifies.

The aforementioned options for creating and/or attaching the edge trim 120 can also be used in the following embodiments in the FIGS. 20 to 22.

In the embodiment illustrated in FIG. 19 the edge trim 120 projects on the edge of the core 119 downward and thus provides an uneven lower side to the holder 102. The mop cover 103 is thus pressed more strongly downward on the edges of the holder 102. This can be prevented by designing the mop cover 103 to be thinner and/or more compressible at the corresponding points.

Figure 20:
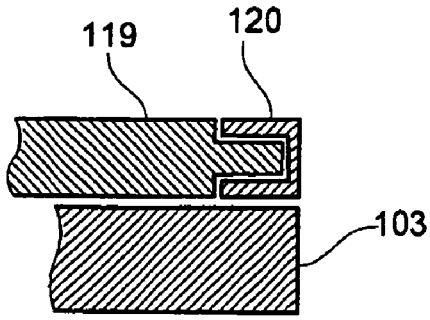

FIG. 20 illustrates another embodiment in which the edge trim 120 has basically the same layout as in the embodiment illustrated in FIG. 19. The edge of the core 119 in this embodiment is designed to be thinner in the region in which the core 119 is overlapped by the edge trim 120. The edge is designed to be thinner by the thickness of the material of the edge trim 120. The holder 102 composed of the core 119 and the edge trim 120 thus has a constant thickness over its entire surface. As a result an even surface acts from the top on the mop cover 103 and applies a constant surface pressure during the mopping process. Moreover, even while wringing out the mop cover 103, it is possible to apply a constant surface pressure on the mop cover 103 using lesser effort if the holder 102 has a constant thickness over its surface.

Figure 21:
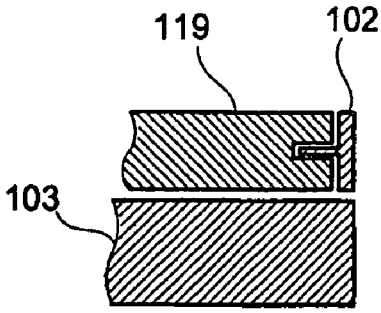

Apart from that, FIG. 21 illustrates an additional embodiment in which the edge trim 120 covers the core 119 only on its sides. The edge trim 120 does not project over or under the upper side and/or lower side of the core 119. As a result, the core 119 can be designed with the same material strength over its entire surface and yet the holder 102 has a constant thickness over its surface if the height of the edge trim 120 is adjusted to the height of the core 119. In the illustrated embodiment for the purpose of attachment a notch is designed in the front sides of the core 119 along its entire periphery. A projection stretching horizontally into the notch is molded on the side of the edge trim 120 that is turned toward the core 119. The projection can in turn have flexible clamping projections in order to be clamped firmly for the purpose of fixing into the notch. Apart from that, this projection for the purpose of clamping into the notch can also be designed to be hollow and compressible.

Figure 22:
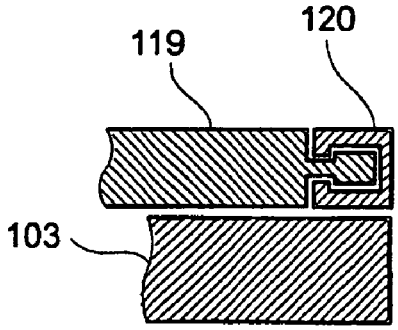
FIG. 22 illustrates an embodiment of the mop pursuant to the invention with a mop cover projecting over the holder.

FIG. 22 illustrates an additional embodiment in which the edge of the core 119 has on its upper side and lower side depressions extending around its periphery into which the edge trim 120 stretches with projections directed downward and/or upward. The edge trim 120 encompasses the edge of the core 119 as has been illustrated in the embodiment in accordance with FIG. 19. In addition, the edge of the core 119 is reset by the edge trim 120 up and down so that the thickness of the core 119 together with the edge trim 120 overlapping the core 119 in the edge region remains constant. The resulting advantage is that the height of the holder 102 remains constant and that additionally the edge trim 120 can be better attached to the core 119.

Figure 23:
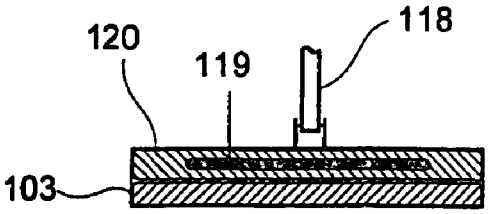
FIG. 23–24 illustrate two additional embodiments of the mop pursuant to the invention.

An additional embodiment is illustrated in FIG. 23 in which the edge trim 120 surrounds the core 119 completely and thus also stretches over its lower side and its upper side. As a result the core 119 is completely enclosed and is not exposed to any corrosive ambience influences. The core 129 [sic] can also be manufactured out of materials that can be corroded by substances acting on the mop 101 during the operation. In this embodiment the material of the core 119 is only required to have the required rigidity. The core 119 is preferably injection-molded with the edge trim 120 and/or its material so as to achieve a seamless covering. The core 119 can comprise of a metal and the edge trim 120 can comprise of a plastic that is suitable for the process of injection molding.

Figure 24:
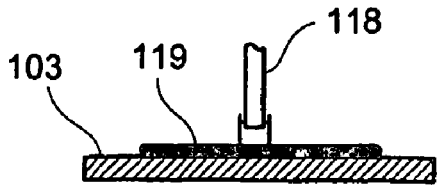

FIG. 24 illustrates an additional embodiment of the present invention in which the edges are protected using a projecting mop cover 103 that acts as a damper for the core 119 as soon as the holder 102 hits against an obstacle because the holder first contacts the obstacle with the projecting edge of the mop cover 103. In addition, in case of a collision with an obstacle, the edge of the mop cover 103 usually arches upward and thus enters between the obstacle and the core 119 thus providing additional damping of the collision.

We claim:

1. A mop, comprising:

a mop cover;

a holder for fastening said mop cover, said holder having a substantially flat, stiff core and an elastic edge trim disposed along and extending about an entire periphery of an edge of said core.

2. The mop according to claim 1, wherein said mop cover projects over at least one part of a periphery of said holder.

3. The mop according to claim 1, wherein said core is formed of metal.

4. The mop according to claim 1, wherein said core is formed of plastic.

5. The mop according to claim 4, wherein said plastic is fiber-reinforced plastic.

6. The mop according to claim 4, wherein said edge trim is formed of plastic and is fused with the plastic material of said core.

7. A mop, comprising:

a mop cover; and a holder for fastening said mop cover, said holder having a substantially flat, stiff core and an elastic edge trim enclosing said core completely.

8. The mop according to claim 1, wherein said core is injection-molded with an edge trim formed of plastic.

9. The mop according to claim 1, wherein said holder is flat and a thickness thereof is constant over an entire expanse thereof.

10. The mop according to claim 1, in combination with a device for wringing out said mop cover, the device having a wringing device with two pressure elements, including a first pressure element disposed to grip onto the edges of a side of said holder lying opposite said mop cover.

11. The mop according to claim 1, wherein the mop is configured as a mobile mop, the mobile mop including a drive for automatically starting a device for regenerating the mop automatically.

12. A mop, comprising:

a mop cover; and a holder for fastening said mop cover, said holder having a substantially flat, stiff core formed of a plastic material and an elastic edge trim disposed along at least one part of said core, said edge trim formed of plastic and fused with said plastic material of said core.

* * * * *